US009138069B2

(12) United States Patent
Cohen et al.

(10) Patent No.: US 9,138,069 B2
(45) Date of Patent: Sep. 22, 2015

(54) CONTINUOUSLY HEIGHT ADJUSTABLE BABY MATTRESS SUPPORT AND APPARATUS THEREFOR

(71) Applicant: M & J SROUR PROPERTIES LLC, South Plainfield, NJ (US)

(72) Inventors: Yehuda Cohen, Tikva (IL); Meir Gitelis, Moshav Shafir (IL)

(73) Assignee: M&J SROUR PROPERTIES LLC., South Plainfield, NJ (US)

( * ) Notice: Subject to any disclaimer, the term of this patent is extended or adjusted under 35 U.S.C. 154(b) by 194 days.

(21) Appl. No.: 13/907,441

(22) Filed: May 31, 2013

(65) Prior Publication Data

US 2014/0007342 A1 Jan. 9, 2014

Related U.S. Application Data

(63) Continuation-in-part of application No. 12/733,182, filed as application No. PCT/IL2008/001138 on Aug. 19, 2008, now Pat. No. 8,484,774.

(60) Provisional application No. 60/956,715, filed on Aug. 20, 2007.

(51) Int. Cl.
*A47D 7/03* (2006.01)
*A47C 19/04* (2006.01)

(52) U.S. Cl.
CPC ..... *A47D 7/03* (2013.01); *A47C 19/045* (2013.01)

(58) Field of Classification Search
CPC ..... A47D 7/03; A47D 19/045
USPC ..... 5/11, 93.1, 611
See application file for complete search history.

(56) References Cited

U.S. PATENT DOCUMENTS

| | | | | |
|---|---|---|---|---|
| 2,504,324 | A | 4/1950 | Goldstein | |
| 2,599,296 | A | 6/1952 | Toomey et al. | |
| 2,650,371 | A | 9/1953 | Showalter | |
| 4,285,079 | A | 8/1981 | Hillman | |
| 4,768,242 | A | 9/1988 | LoTurco | |
| 5,056,170 | A * | 10/1991 | Kronshagen | 5/10.1 |
| 5,377,787 | A | 1/1995 | Chabrier | |
| 5,747,745 | A | 5/1998 | Neuman | |
| 6,629,322 | B1 | 10/2003 | Monroe | |

(Continued)

FOREIGN PATENT DOCUMENTS

| | | |
|---|---|---|
| DE | 196 22 937 A1 | 12/1997 |
| GB | 2 287 315 A | 9/1995 |

(Continued)

*Primary Examiner* — Michael Trettel
(74) *Attorney, Agent, or Firm* — Birch, Stewart, Kolasch & Birch, LLP

(57) ABSTRACT

A continuously height adjustable mattress support and apparatus therefor is disclosed. The mattress support is vertically displaceable by means of at least one drive unit for applying a vertical force to a corresponding solely vertically displaceable driven component and is stabilized during vertical displacement by at least one stabilizing means connected thereto. The driven component is connected to, or is in supporting relation with, the mattress support, so that a height of the mattress support above a floor surface is settable and continuously adjustable by means of at least one actuator associated with the at least one drive unit. In one embodiment, a locking device for preventing displacement of the mattress support following inadvertent actuation of the at least one drive unit is employed.

16 Claims, 30 Drawing Sheets

(56) References Cited

U.S. PATENT DOCUMENTS

| | | | | |
|---|---|---|---|---|
| 6,779,210 | B1 * | 8/2004 | Kelly | 5/611 |
| 7,827,631 | B2 | 11/2010 | Holman | |
| 8,484,774 | B2 * | 7/2013 | Cohen et al. | 5/93.1 |
| 2002/0130286 | A1 | 9/2002 | Eckstein et al. | |
| 2010/0005586 | A1 | 1/2010 | Kappenberg | |
| 2011/0203049 | A1 * | 8/2011 | Carta | 5/93.1 |

FOREIGN PATENT DOCUMENTS

| | | | |
|---|---|---|---|
| GB | 2 422 303 | A | 7/2006 |
| GB | 2 429 400 | A | 2/2007 |
| IT | 1238733 | | 5/1990 |

* cited by examiner

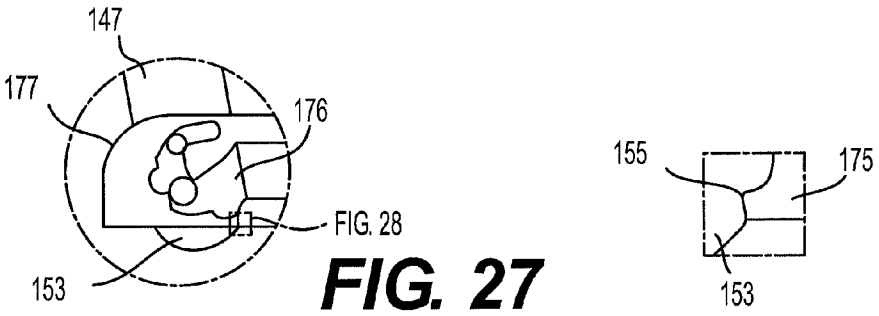
FIG. 24
FIG. 27
FIG. 28
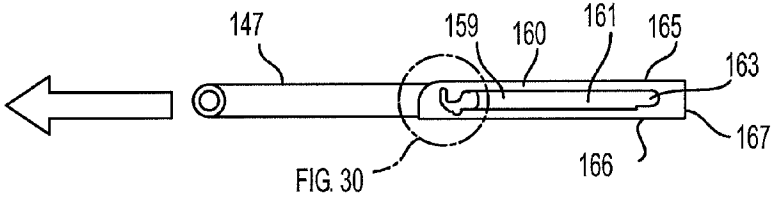
FIG. 25
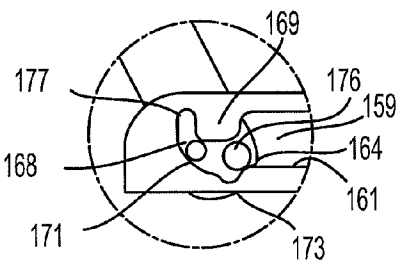
FIG. 29
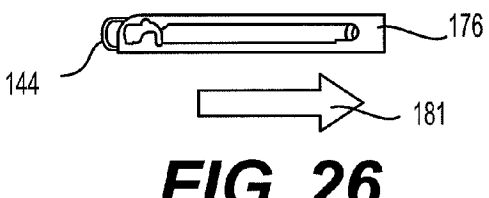
FIG. 26
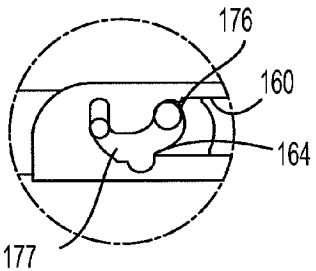
FIG. 30

CONTINUOUSLY HEIGHT ADJUSTABLE BABY MATTRESS SUPPORT AND APPARATUS THEREFOR

CROSS-REFERENCE TO RELATED PATENT APPLICATIONS

This application is a Continuation in Part (CIP) of U.S. application Ser. No. 12/733,182 filed on Feb. 16, 2010, which claims priority of provisional patent application No. 60/956,715, filed on Aug. 20, 2007, which are incorporated herein by reference in their entirety.

FIELD OF THE INVENTION

The present invention relates to the field of baby cribs. More particularly, the invention relates to apparatus by which the height of a mattress support may be continuously adjusted.

BACKGROUND OF THE INVENTION

Many height adjustable baby mattress supports are known in the prior art. The most commonly available height adjustable baby crib is one that requires manual disassembly of at least a portion of the crib main frame and of components such as brackets that attach the mattress support to the main frame. After the mattress support is positioned at a desired height, the brackets and main frame have to be reassembled.

Such types of baby cribs suffer from several disadvantages: It is necessary to assemble and disassemble the main frame and mattress support to accommodate the growth of the baby, causing user discomfort during a time consuming and awkward assembly operation.

When a baby needs to be diapered, cared for, or dressed, the attendant has to bend over the upper railing of the crib in order to access the baby. Intermittent bending motions of the attendant result in back pains since the mattress support is positioned at a set height, and it is inconvenient to change the height of the mattress support.

The main frame of prior art cribs is generally configured with means to set the mattress support at one of a predetermined number of height levels, e.g. three different height levels. Many attendants are desirous of setting the mattress support at one or more different levels.

Various continuously height adjustable baby mattress supports are also known in the prior art; however, the associated apparatus for adjusting the mattress support height is a relatively complex mechanism.

U.S. Pat. No. 2,599,296 discloses an adjustable crib spring which is arranged to be raised and lowered, two pairs of geared levers at each end of the crib and provided with tension springs to tend to draw them together to raise the crib spring, handles on the crib spring for manual movement of the latter, and catches on the crib. One lever at each end of the crib is connected to a corresponding lever at the other end of the crib by means of a shaft so that the levers are forced to move together and that tilting of the crib spring is prevented.

U.S. Pat. No. 4,285,079 discloses an apparatus by which a mattress support is raised and lowered by flexible hoist members attached to a winding bar that is rotatably journaled in two housings. The hoist members are threaded through the housings and attached to the winding bar. At their ends, the hoist members are secured by brackets to a spring frame that forms part of the mattress support.

IT 1238733 discloses a child's bed having a manually moveable mattress frame with a spring and gas piston system for guidance and counterweight.

GB 2422303 discloses a cot with a height-adjustable mattress base. Support means are provided taking the form of scissor-pivoted leg members. A switch controlling a linear actuator causes the leg members to be pushed open to lower the mattress or pushed together to raise the mattress.

SUMMARY OF THE INVENTION

The present invention provides a system for continuous height adjustment of a mattress support in a baby crib, said system comprising: at least one driven component engaging said mattress support, at least one drive unit configured for applying a vertical force to said driven component for continuous vertical displacement thereof;

a) at least one actuator associated with said at least one drive unit for operating thereof to allow continuous adjustment of a height of said mattress support above a floor surface and at least one locking device configured for preventing displacement of said mattress support in a releasable manner by disabling and re-enabling said at least one actuator, respectively.

According to some embodiments of the present invention the actuator comprises a control box configured to communicate with said locking device and to operate said at least one drive unit according to signals received form said locking device, said locking device further includes a control panel for enabling a user to control displacement of said mattress support and disabling of said actuator through a single panel unit.

According to some embodiments of the present invention the control box connects to said control panel of said locking device and to said at least one drive unit to allow operating each said drive unit according to electric signals received form said control panel.

According to some embodiments of the present invention the at least one drive unit comprises at least one piston operable by said actuator, each said piston engages said driven component to allow continuous vertical displacement thereof.

The system according to claim 4, wherein said at least one driven component comprises at least one bracket connected to said at least one piston allowing thereby to be vertically displaced thereby, said bracket are movable between two rails in the crib.

According to some embodiments of the present invention the rails are attachable to said crib and are telescopically extendable.

According to some embodiments of the present invention the locking device comprises a disabling button for disabling said at least one actuator by cutting off electric power supply thereto.

According to some embodiments of the present invention the at least one stabilizing means engaging said at least one drive unit for stabilizing the vertical displacement of said mattress support.

According to some embodiments of the present invention the actuator comprises a bar and said locking device comprises at least one retractable pin that engages said bar, wherein said pin is arranged to hold said bar between grips that hold said mattress support for preventing vertical displacement thereof.

The present invention provides a baby crib comprising: a crib structure having multiple leg posts, a substantially horizontal mattress support configured for horizontally supporting a mattress in a baby crib, at least one driven component engaging said mattress support, at least one drive unit configured for applying a vertical force to said driven component for continuous vertical displacement thereof, at least one actuator associated with said at least one drive unit for operating thereof to allow continuous adjustment of a height of said mattress support above a floor surface; and at least one locking device configured for preventing displacement of said mattress support in a releasable manner by disabling and re-enabling said at least one actuator, respectively.

According to some embodiments of the present invention the actuator comprises a control box configured to communicate with said locking device and to operate said at least one drive unit according to signals received form said locking device, said locking device further includes a control panel for enabling a user to control displacement of said mattress support and disabling of said actuator through a single panel unit.

According to some embodiments of the present invention the said control box connects to said control panel of said locking device and to said at least one drive unit to allow operating each said drive unit according to electric signals received form said control panel.

According to some embodiments of the present invention the at least one drive unit comprises at least one piston operable by said actuator, each said piston engages said driven component to allow continuous vertical displacement thereof.

According to some embodiments of the present invention the at least one driven component comprises at least one bracket connected to said at least one piston allowing thereby to be vertically displaced thereby, said bracket is movable between two rails in the crib.

According to some embodiments of the present invention the said rails are attachable to said crib and are telescopically extendable.

According to some embodiments of the present invention the actuator is electrically operated and said locking device comprises a disabling button for disabling said at least one actuator by disconnecting power supply thereto.

According to some embodiments of the present invention the baby crib further comprising at least one stabilizing means engaging said at least one drive unit for stabilizing the vertical displacement of said mattress support.

According to some embodiments of the present invention the actuator comprises a bar and said locking device comprises at least one retractable pin that engages said bar, wherein said pin is arranged to hold said bar between grips that hold said mattress support for preventing vertical displacement thereof.

BRIEF DESCRIPTION OF THE DRAWINGS

In the drawings:

FIG. 24 is a front view of a grooved unit and of an arm engaged therewith which is in an upwardly rotated position;

FIG. 25 is a front view of a grooved unit and of an arm engaged therewith which is in an extended position;

FIG. 26 is a front view of a grooved unit and of an arm engaged therewith which is in a retracted position;

FIG. 27 is an enlarged view of FIG. 24, showing how the arm is seated in the grooved unit in one angular position;

FIG. 28 illustrates a rear view of a portion of the grooved unit and of the arm end, showing additional means to secure the arm at a given angle;

FIG. 29 is an enlarged front view of a grooved unit and of an arm engaged therewith, showing how the arm is seated in the grooved unit in another angular position;

FIG. 30 is an enlarged view of FIG. 25;

DETAILED DESCRIPTION OF SOME EMBODIMENTS OF THE INVENTION

The present invention is a continuously height adjustable baby mattress support which can be set at any desired height level above a floor surface. The apparatus for adjusting the mattress support comprises a simple drive unit that includes a corresponding solely vertically displaceable driven component for urging the mattress support to be displaced in a similar direction. Prior art apparatus for continuously adjusting the height of a baby mattress support, in contrast, comprises a relatively complex mechanism including a driven component that is displaced in a direction that is not solely vertical, in order to accommodate linkage means connected to the mattress support that are also displaced in response to the driven component towards a direction that is not solely vertical, thereby increasing the cost and complexity of the apparatus.

Figure 1:
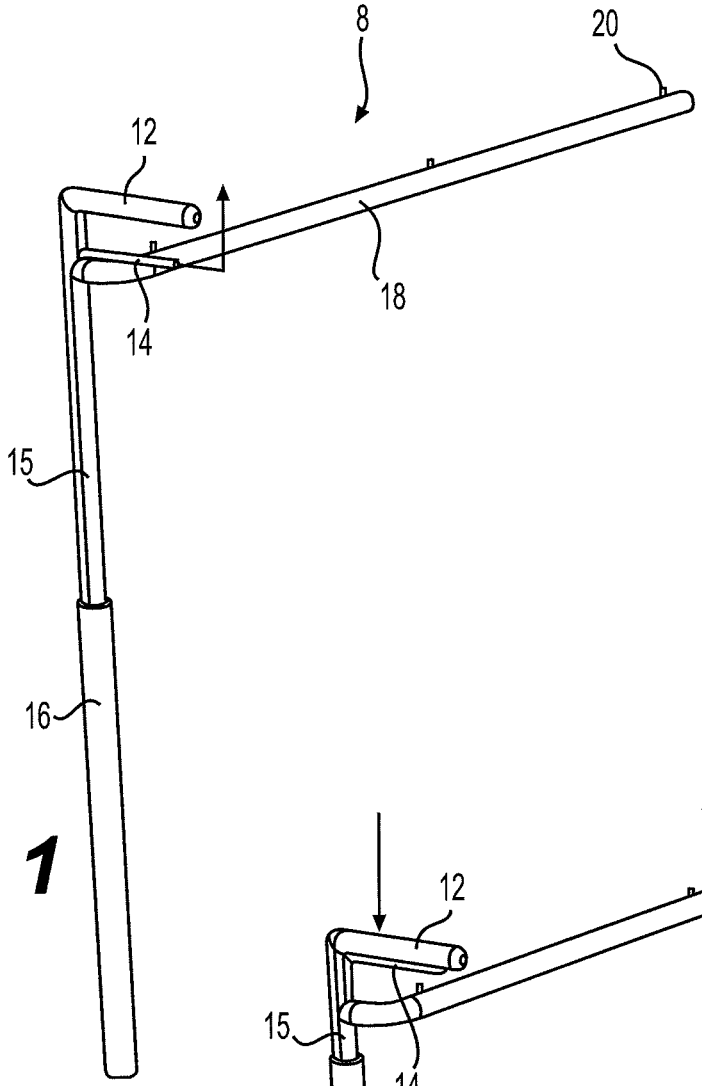
FIG. 1 is a perspective of a drive unit for continuously adjusting the height of a baby mattress support according to one embodiment of the invention, showing a crossbar in its uppermost position.

FIG. 1 illustrates a drive unit indicated generally by numeral 8 for continuously adjusting the height of a baby mattress support, according to one embodiment of the present invention. Drive unit 8 comprises a vertically disposed piston housing 16, a vertically disposed piston 15 shown in a fully raised position and which is adapted to be displaced downwardly within piston housing 16 when the mattress support is to be lowered and to be displaced upwardly when the mattress support is to be raised, a horizontally disposed crossbar 18 extending from piston 15, a fixed handle 12 extending from the uppermost portion of piston 15 which may be horizontally disposed and substantially perpendicular to the underlying crossbar 18, and a release member 14, which may be horizontally disposed, extending from piston 15 and interposed between handle 12 and crossbar 18, for enabling displacement of piston 15. Crossbar 18 is adapted to support the mattress support in cantilevered fashion, is made of, as well as piston 15 connected thereto, a sufficiently structurally strong material that can safely support the mattress support, as well as a mattress and infant positioned there-above.

Figure 2:
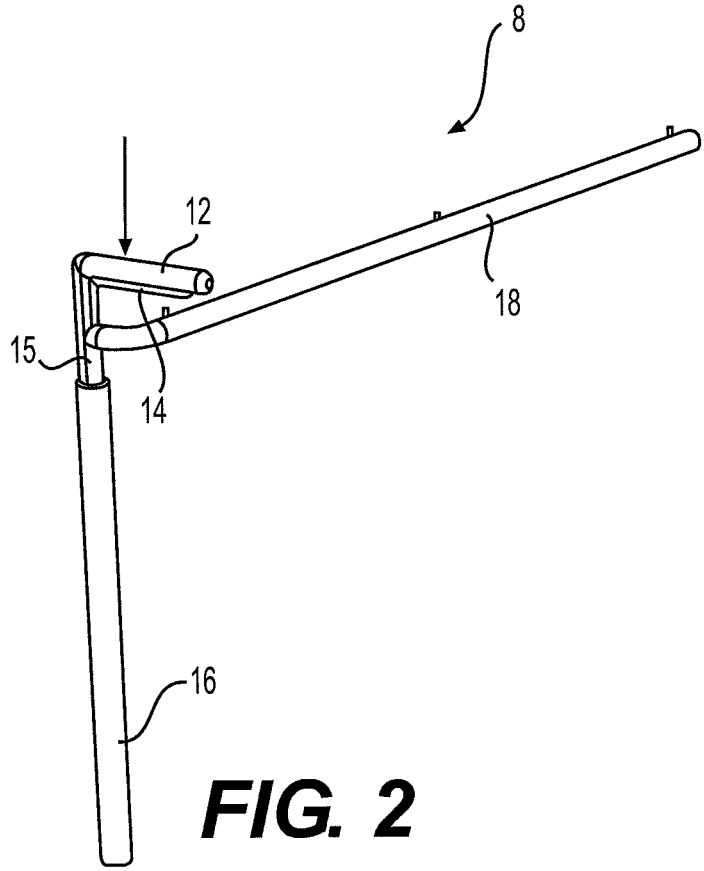
FIG. 2 is a perspective of the drive unit of FIG. 1 in which a crossbar is shown in its lowermost position.

FIG. 2 illustrates piston 15 in its lowermost position. When release member 14 is upwardly pulled towards handle 12, as shown, piston 15 is able to be lowered.

Figure 3:
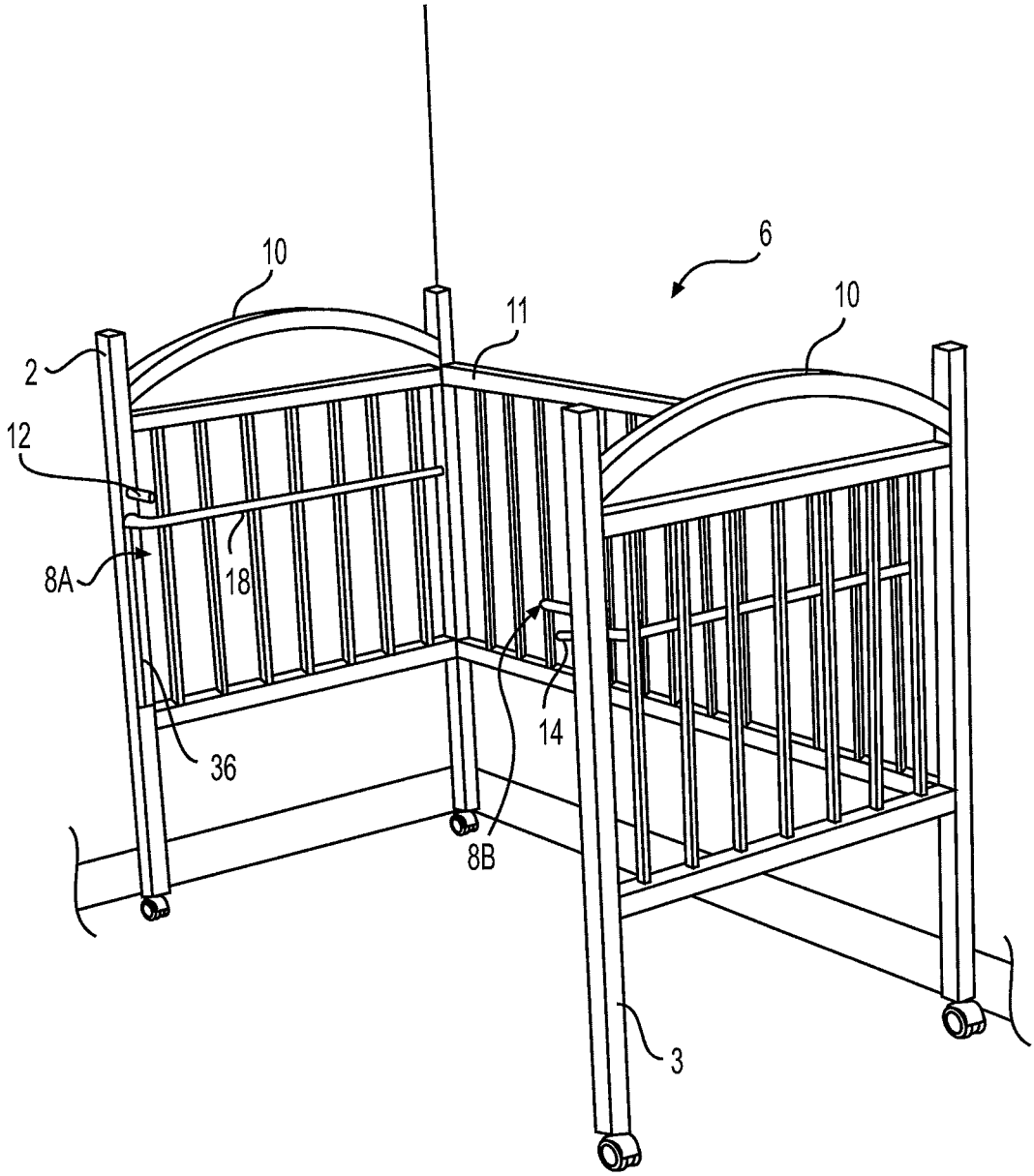
FIG. 3 is a perspective view of a baby crib from which one of its side units has been removed, showing two drive units of FIG. 1 that have been mounted within adjacent leg posts.

FIG. 3 illustrates a perspective view of a baby crib 6 from which one of its side units has been removed for clarity, in order to illustrate two drive units 8A and 8B that have been mounted within adjacent leg posts 2 and 3, respectively. Crib 6 comprises two opposing stationary end units 10 and two opposing stationary side units 11. As shown, adjacent leg posts 2 and 3 are hollowed out and a vertically oriented groove 36, e.g. an elliptical groove, is formed along opposed faces of leg posts 2 and 3, respectively, to allow insertion therein of a corresponding piston housing and piston and to allow the corresponding handle 12 and release member 14 to be freely displaced therealong when the height of the mattress support is being adjusted. After being inserted within the interior of a corresponding leg post, piston housing 16 contacts the inner wall of the leg post. The length of groove 36 is equal to, or greater than, the maximum difference in height of the mattress support between its uppermost and lowermost positions. The length of crossbar 18 is substantially equal to the width of the mattress support, extending along the length of the corresponding end unit 10 of crib 6 and terminating before contacting the second leg post from which the corresponding end unit is comprised. By mounting drive units 8A and 8B within leg posts 2 and 3, respectively, compactness of the height adjusting apparatus is maximized without compromising safety.

Figure 4:
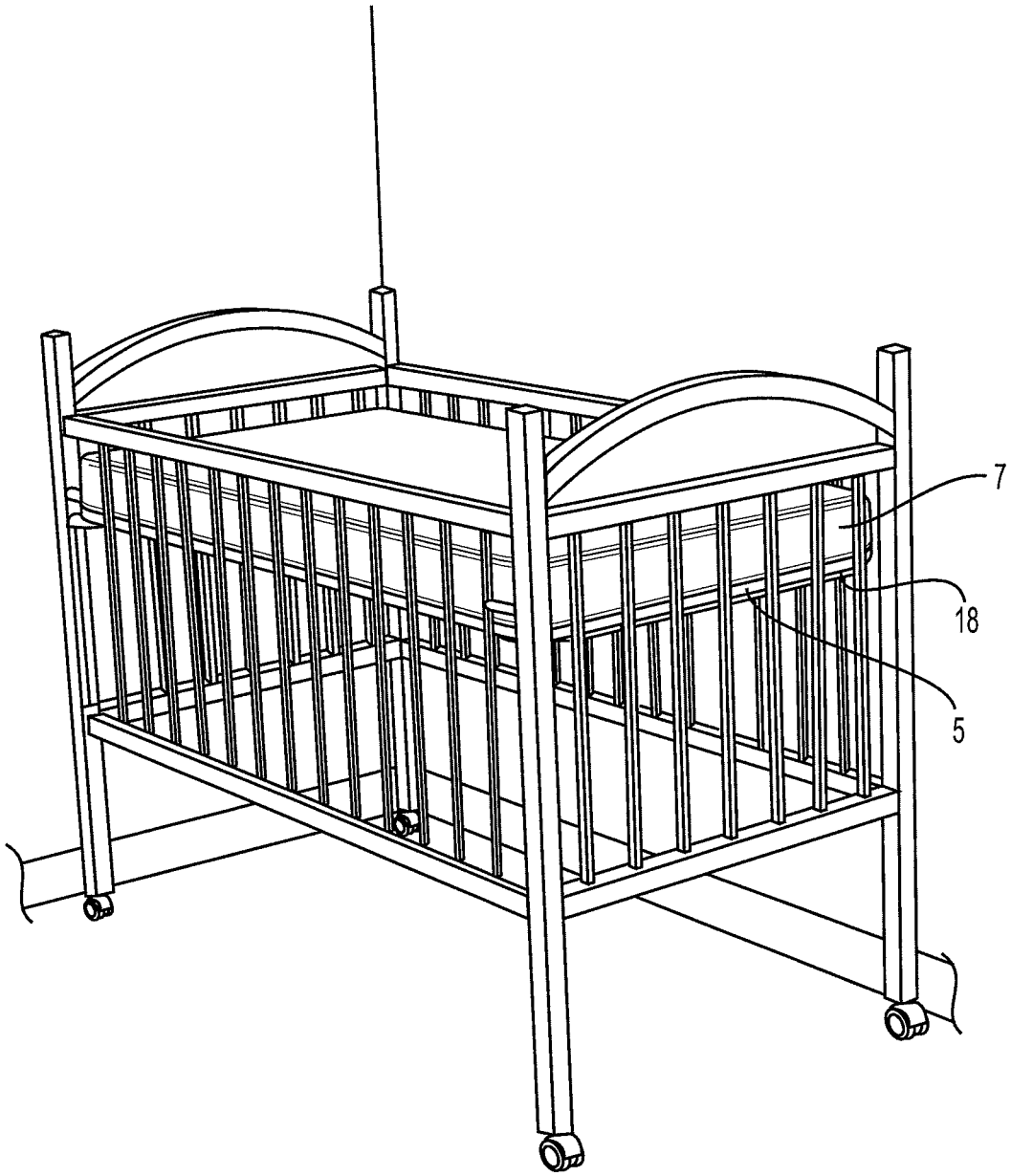
FIG. 4 is a perspective view of the baby crib of FIG. 4, showing its mattress support in an uppermost position.

FIG. 4 illustrates mattress support 5 at an uppermost position. The oppositely positioned pair of crossbars 18 support the mattress support 5 in cantilevered fashion, while mattress support 5 supports mattress 7. Crossbars 18, which may be tubular or of rectangular cross section, may be attached to mattress support 5 by means of screws 20 (FIG. 1) or any other suitable attachment means. Alternatively, crossbars 18 may support the mattress support without being attached thereto. It will be appreciated that any number of crossbars 18 from one to four may be employed to support the mattress support 5. When two crossbars are employed, they may extend along the width of support surface 5 as shown, or alternatively, may extend along the length thereof. Similarly, any number from one to four of drive units for vertically displacing a crossbar may be employed. When four drive units and two crossbars are employed, each crossbar is connected to two opposing pistons.

Figure 5:
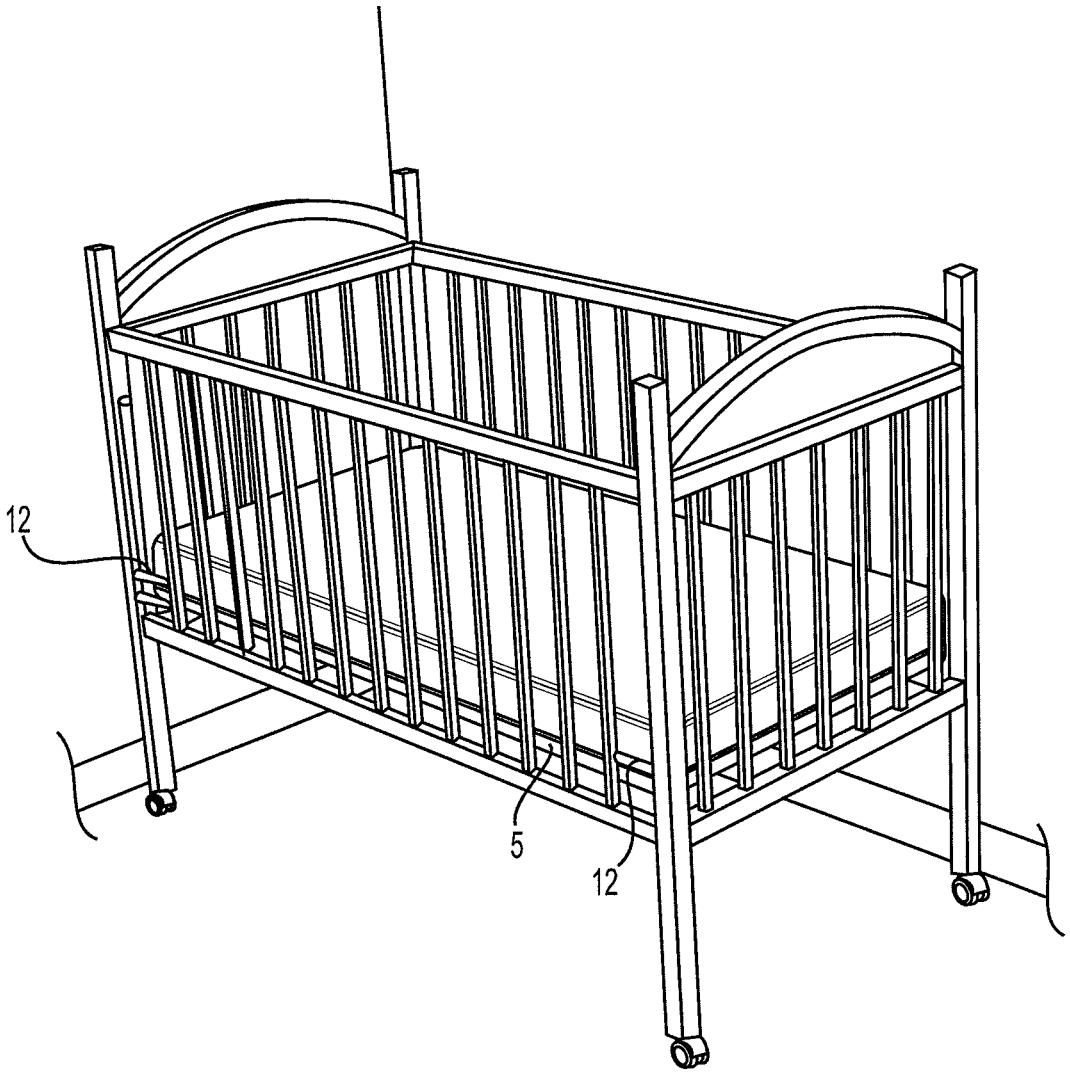
FIG. 5 is a perspective view of the baby crib of FIG. 4, showing its mattress support in a lowermost position.

FIG. 5 illustrates mattress support 5, as well as the two handles 12, at a lowermost position. By suitably manipulating the handles and release members, the height of mattress support 5 can be set at any desired value between the uppermost and lowermost positions. Accordingly, the use of a baby crib with the drive unit of the present invention obviates the need of a separate changing table since the height of the mattress support can be quickly and simply adjusted.

Figure 6:
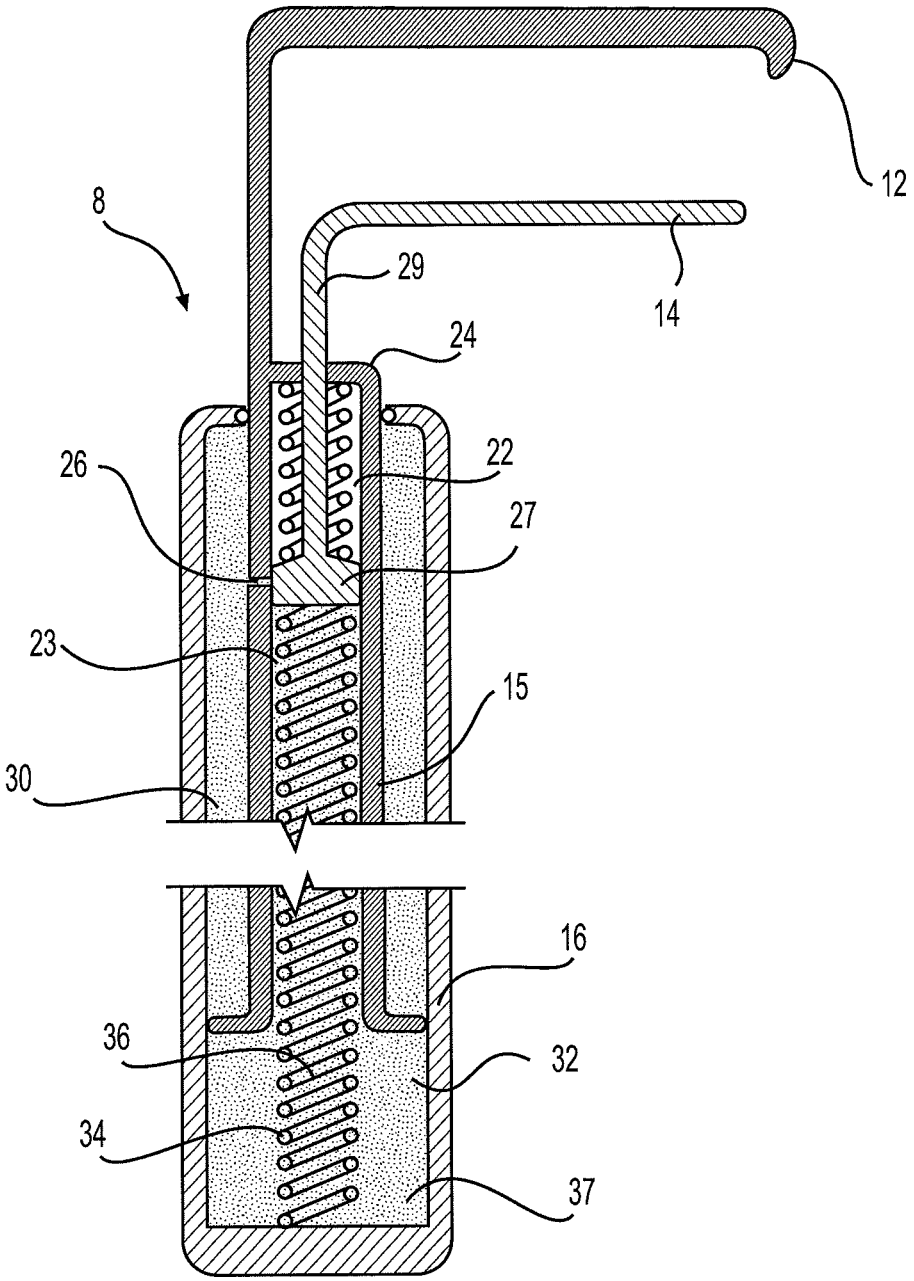
FIG. 6 is a vertical cross section of a hydraulically actuated piston used in conjunction with the drive unit of FIG. 1.

FIG. 6 illustrates a vertical cross sectional drawing of drive unit 8, showing the operation of hydraulically actuated piston 15. As shown, release member 14 has a plunger element 27 which sealingly engages the inner wall of, and is displaceable with respect to, piston 15, separating the hollow interior of piston 15 into variable-volume chambers 22 and 23. A vertical stem 29 extends from plunger element 27 to horizontal release member 14. Upper spring 24 is mounted about stem 29 within chamber 22, and lower spring 34 is disposed within chamber 23. Lower spring 34 is mounted about post 36 extending from the bottom surface 37 within the interior of piston housing 16. An aperture 26 in communication with chamber 23 is formed within a wall of piston 15. Upper spring 24 is biased when in a relaxed state to urge plunger element 27 to a position within the interior of piston 15 so as to occlude aperture 26.

In order to adjust the height of the mattress support, release member 14 is drawn towards handle 12, causing upper spring 24 to be contracted and aperture 26 to be exposed due to the displacement of plunger element 27. Hydraulic fluid then flows to chamber 23, assisting in the displacement of piston 15 upon application of a manual force to handle 12.

Figure 7:
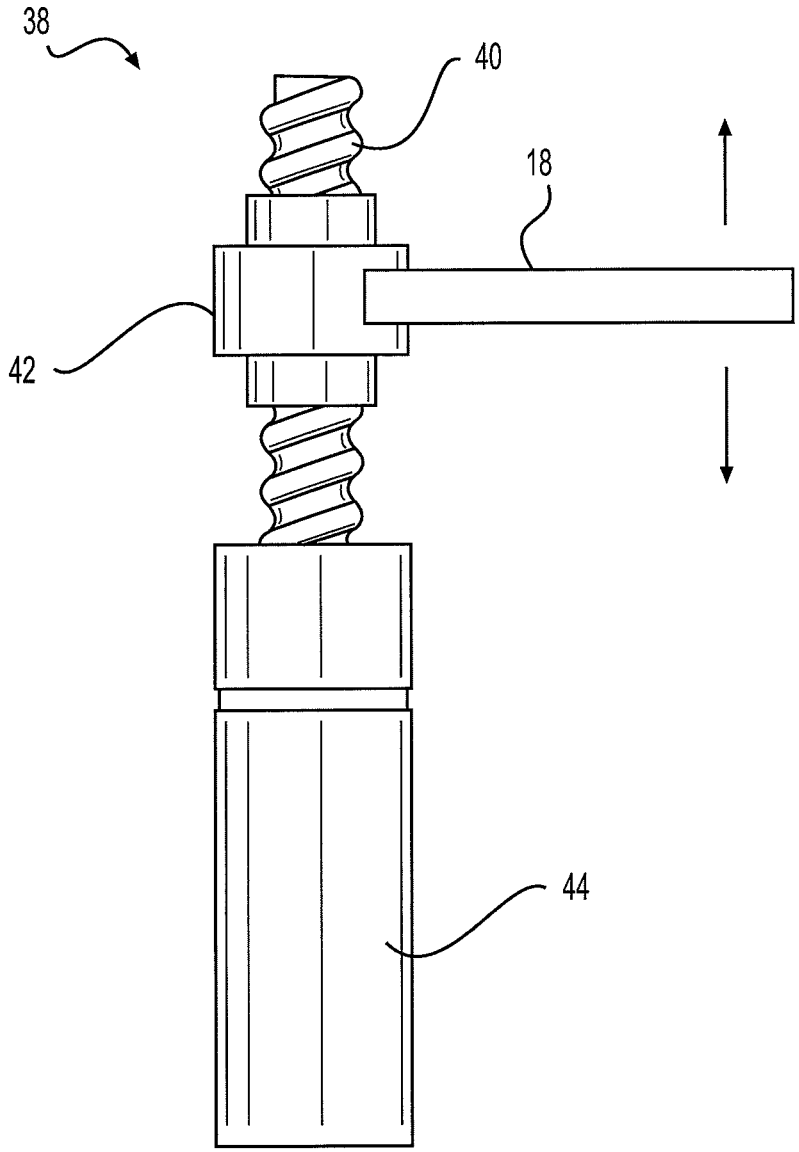
FIG. 7 is a front view of a drive unit according to another embodiment of the invention.

FIG. 7 illustrates an electrically actuated drive unit 38. Drive unit 38 comprises motor housing 44 insertable within a crib leg post, vertically disposed screw element 40 which is threadedly engaged with the electrically powered motor so as to be vertically displaceable, non-rotatable and vertically displaceable collar element 42 encircling and engageable with screw element 40, and solely vertically-displaceable and horizontally disposed crossbar 18 which is attached to collar element 42, thereby preventing the rotation of collar element 42. When connected to crossbar 18, a mattress support becomes continuously height adjustable.

It will be appreciated that screw element 40, or a vertically oriented element such as a rod, may be vertically displaced by means of a spring arrangement.

Figure 41:
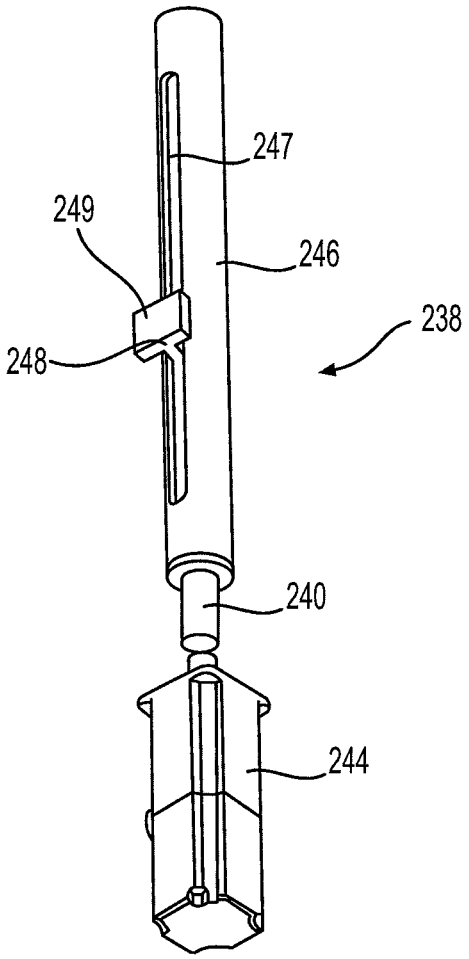
FIG. 41 is a perspective view of another embodiment of a drive unit.

Another electrically actuated drive unit is illustrated in FIG. 41. Drive unit 238 comprises stationary motor housing 244, vertically disposed screw element 240 which is threadedly engaged with the electrically powered motor so as to be vertically displaceable, tubular sleeve element 246 fixed to a portion of the baby crib, e.g. an end unit, which encircles screw element 240 and is formed with a vertical groove 247, protruding element 248 threadedly engaged with screw element 240 and which extends through groove 247, and solely vertically displaceable plate 249 attached to protruding element 248 so as to be vertically displaceable along groove 247. When connected to plate 249, a mattress support becomes continuously height adjustable.

FIGS. 8-13 illustrate another embodiment of the invention wherein a mattress support is vertically displaced by means of two pneumatically actuated pistons.

Figure 8:
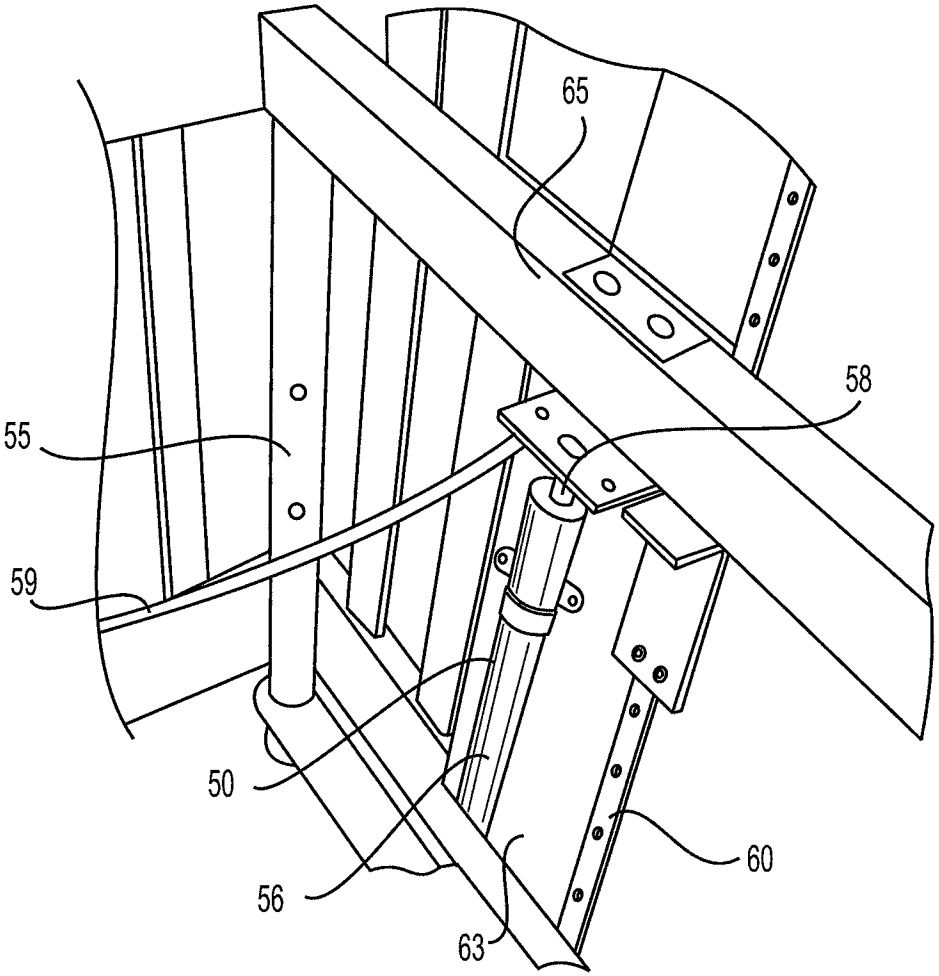
FIG. 8 is a perspective view of apparatus for continuously adjusting the height of a baby mattress support according to another embodiment of the invention.

FIG. 8 illustrates apparatus 50 associated with baby crib 55 for continuously adjusting the height of a baby mattress support. Apparatus 50 comprises cylinder 56, which is sometimes referred to as a "gas spring", piston rod 58 vertically reciprocating above and within cylinder 56, cable 59, e.g. a Bowden wire, coupled to piston rod 58 for effecting motion thereto, linear bearing 60 for stabilizing the mattress support as it is displaced vertically, and a horizontal frame element 65 to which piston rod 58 and linear bearing 60 are connected, as will described hereinafter. Gas spring 56 applies a force to vertically displace piston rod 58 by means of a compressed gas contained in a cylinder and a piston for variably compressing the gas. A pair of gas spring 56 and linear bearing 60 is attached to central portion 63 of each end unit of crib 55 in order to vertically displace a corresponding side of frame element 65. If will be appreciated that the linear bearings 60 may be attached to a side unit of crib 55, or to any other selected portion of the crib.

Figure 9:
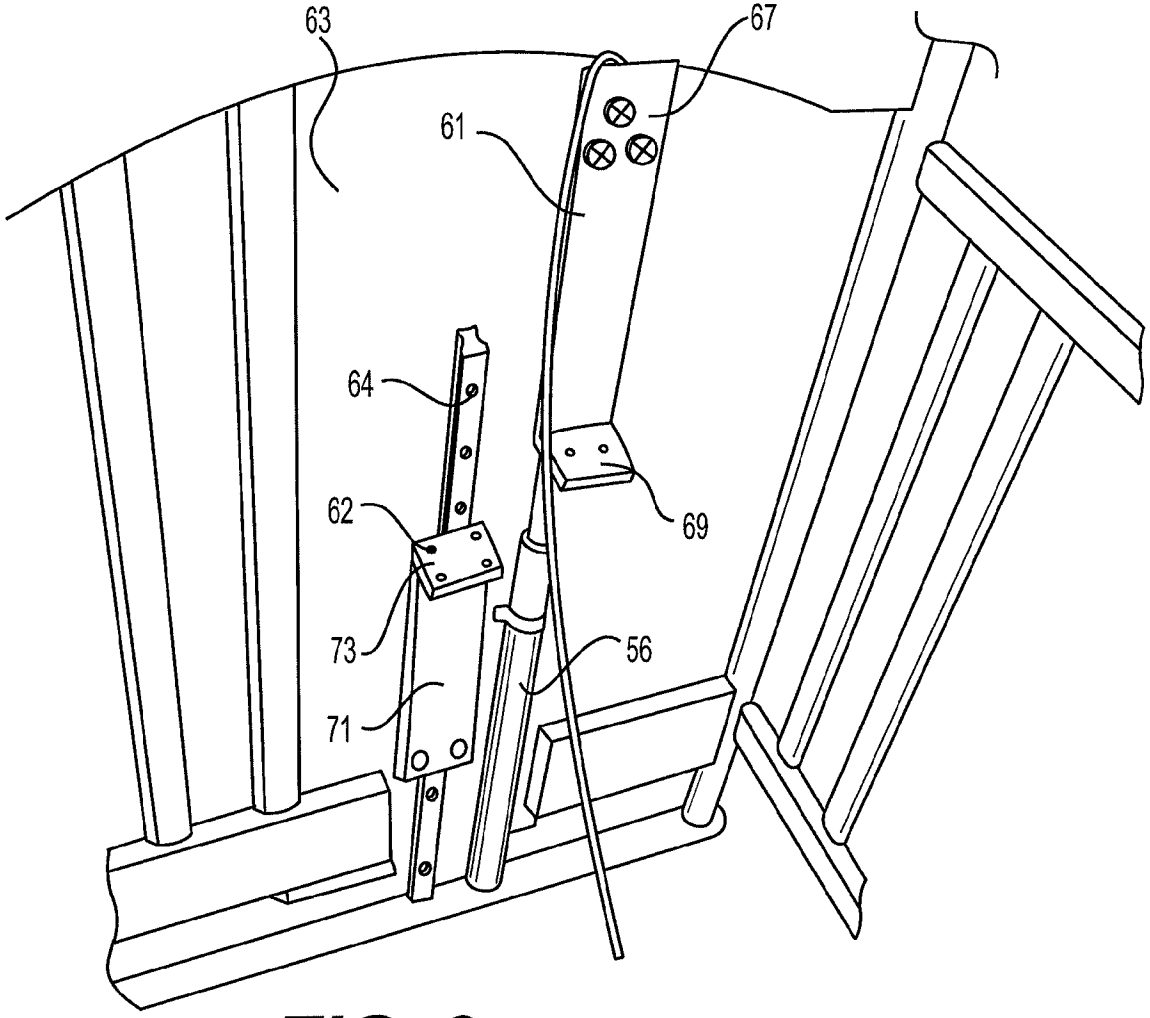
FIG. 9 is a perspective view of some of the apparatus of FIG. 8, showing attachment plates that are connected to a piston rod and linear bearing, respectively.

FIG. 9 illustrates two L-shaped attachment plates 61 and 62 that are connected to piston rod 58 and linear bearing 60, respectively. Elongated vertically oriented portion 67 is connected to piston rod 58, and terminates at its lower end with a short horizontally oriented leg portion 69 which is to be connected to the frame element. The maximum height of leg portion 69 above cylinder 56 is selected to set the uppermost height of the mattress support, and the lowermost height of the mattress support is set by the lowest height of leg portion 69 above floor surface F. Vertical portion 71 of attachment 62 is connected to the runners of linear bearing 60, and horizontal portion 73 thereof which is also to be connected to the frame element extends from the upper end of vertical portion 71.

Figure 10:
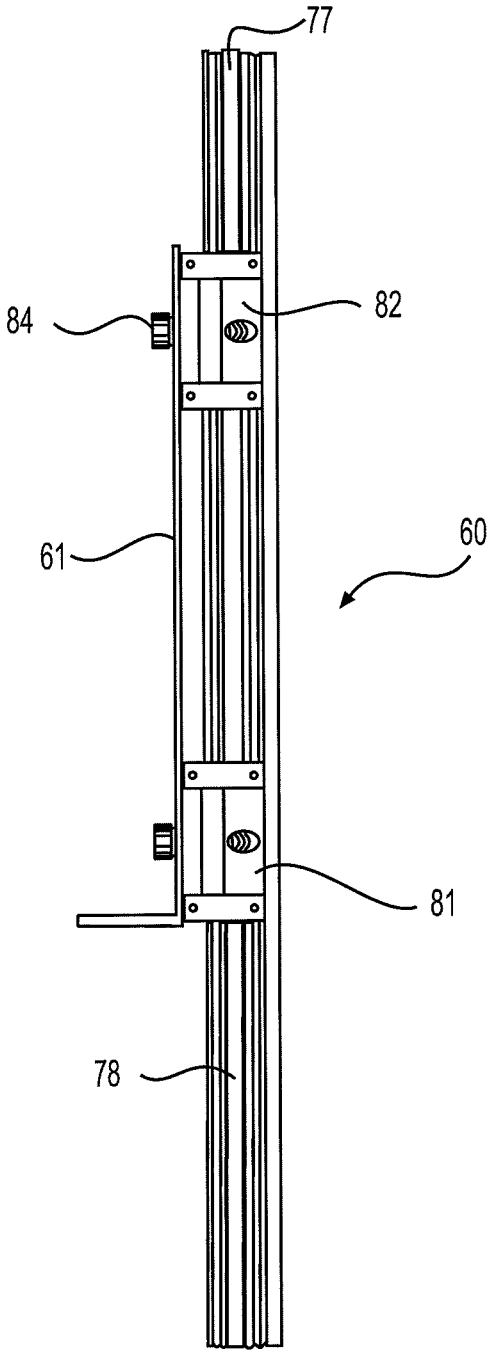
FIG. 10 is a side view of the vertically oriented linear bearing of FIG. 9.

As shown in FIG. 10, linear bearing 60 comprises vertically oriented rail 77 having a set of tracks 78 at each side thereof and fixed to central portion 63 of the crib by means of attachment means 64 (FIG. 9) introduced to each of a plurality of apertures bored in rail 77, two vertically spaced runners 81 and 82 slidably engaged with a common set of tracks 78, and attachment 61 connected to each of the two runners by attachment means 84, e.g. two bolts. The use of two runners cancels the torque that would be applied to the linear bearing when a baby stands at one end of the mattress. The construction of a linear bearing is well known to those skilled in the art, and need not be described for brevity. The BRH15A runner model manufactured by ABBA Linear Tech Co., LTD., Taiwan may be employed wherein the vertical spacing between each vertically spaced runner is 10-15 cm. The length of the rail may be 1.27 m and its width may be 0.6 m.

Figure 11:
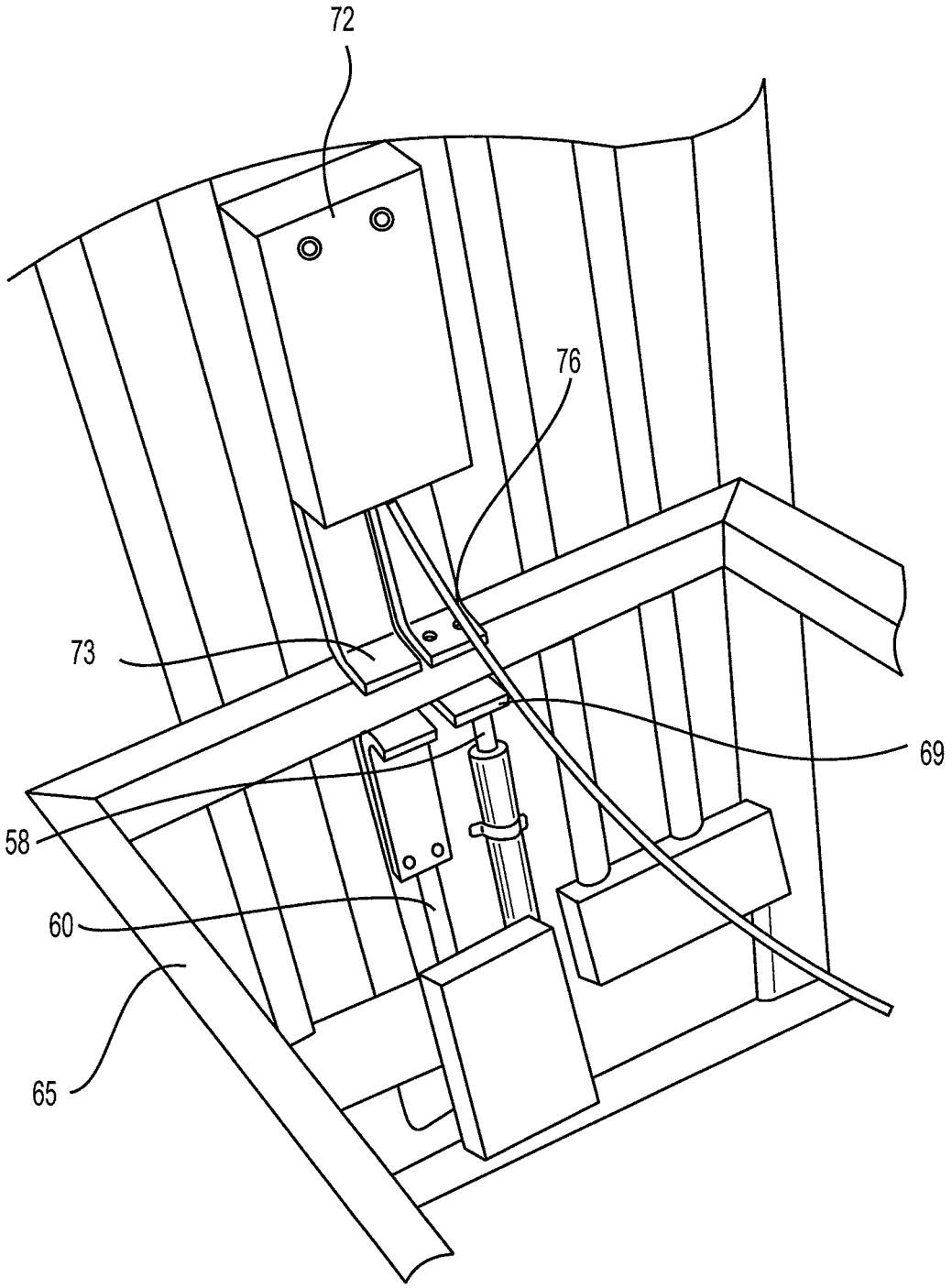
FIG. 11 is a perspective view of a frame element and attachment plate cover used in conjunction with the apparatus of FIG. 8.

In FIG. 11, frame element 65 is shown to be connected to piston rod 58 and linear bearing 60 by means of horizontal attachment portions 69 and 73, respectively. The attachment portions may be connected above or below frame element 65. A bracket portion 76 connected to a corresponding horizontal attachment portion, as shown, may also be attached to frame element 65, if so desired. When a linear bearing is employed, tests conducted by the applicants have revealed that torque resulting from the application of an excessive load on one end of the crib is absorbed by the frame element only when it is a single integral unit. A cover 72 for covering the attachment portions as well as other apparatus associated with the invention in a safe and aesthetic fashion as the mattress support is vertically displaced may be provided. Cover 72 may be made of plastic, rubber, or any other suitable material, and may be associated with another cover element made of similar materials. For example, cover 72 may be permanently fixed to piston rod 58 and linear bearing 60, and may be periodically introduced within the interior of the other cover element. The other cover element may also be configured so as to be introduced within the interior of cover 72. Alternatively, the other cover element may be compressed when brought in contact with cover 72.

Figure 12:
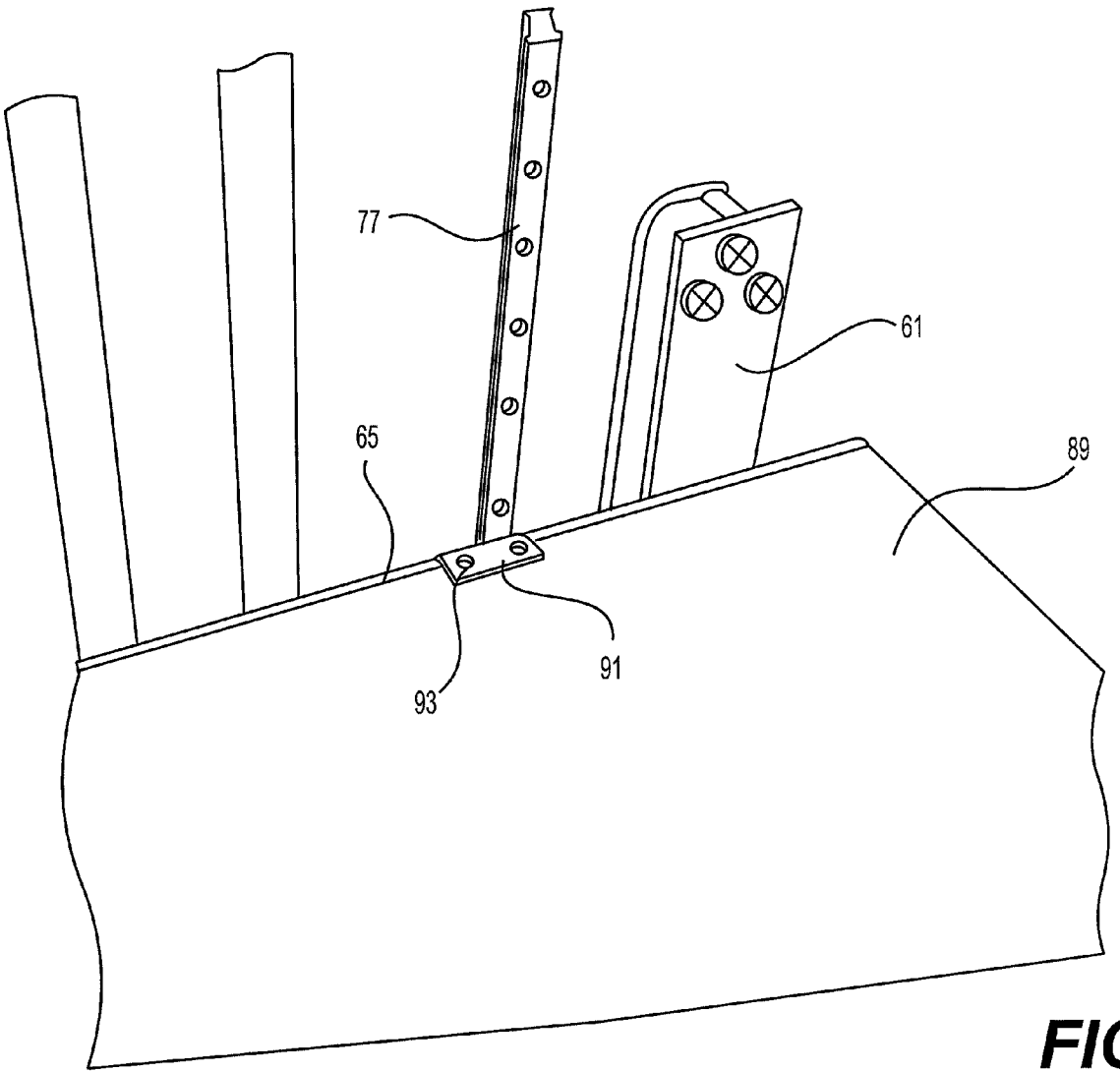
FIG. 12 is a perspective view of a baby crib end unit to which is attached the apparatus of FIG. 8, showing a frame element connected to a mattress support.

In FIG. 12, a mattress support 89 is shown to be connected to frame element 65 by means of bracket element 91 and attachment means 93.

Figure 13:
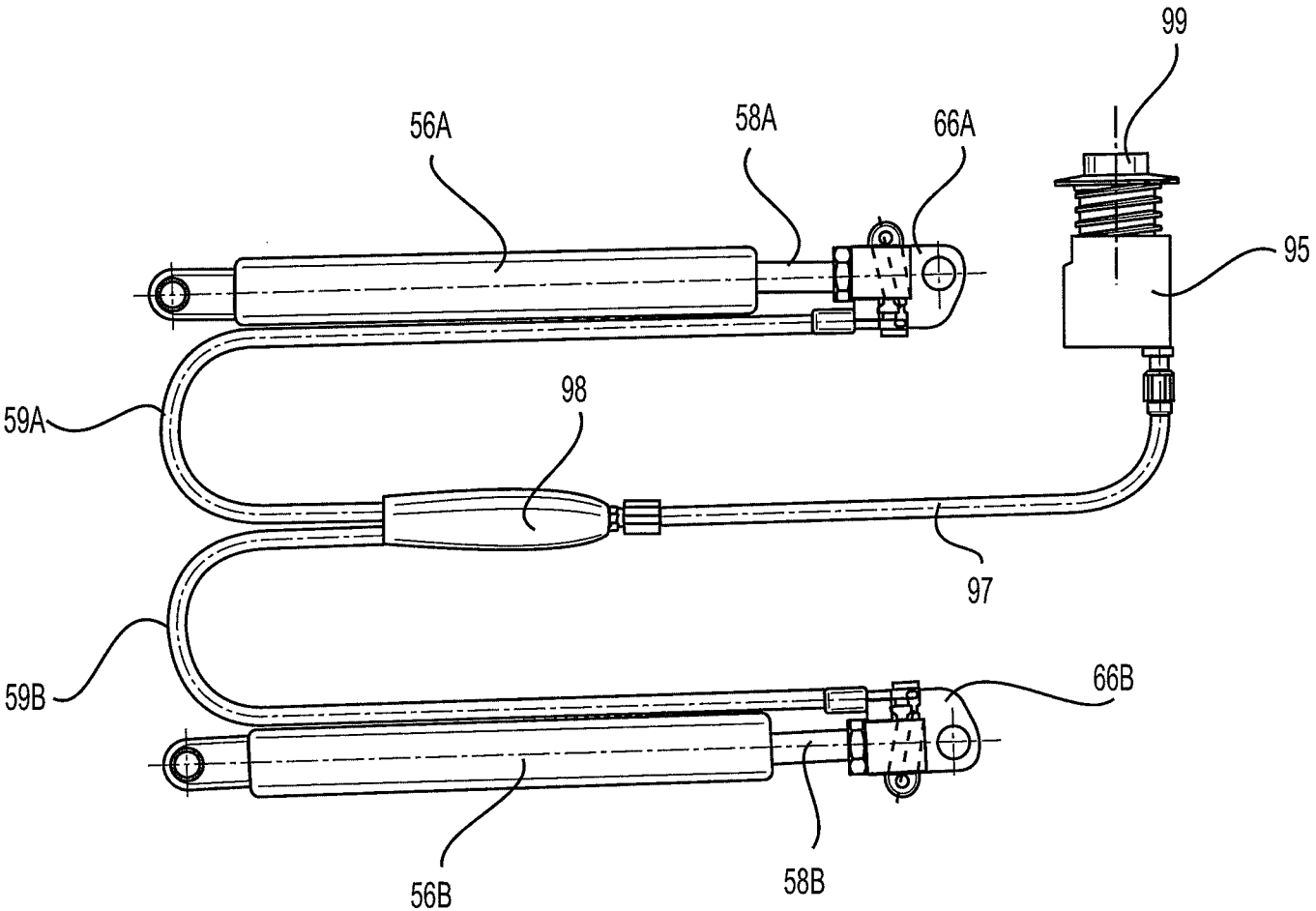
FIG. 13 is a schematic view of an actuator for simultaneously displacing two piston rods of oppositely mounted gas springs, respectively.

As shown in FIG. 13, the vertical displacement of two piston rods 58A and 58B with respect to cylinders 56A and 56B, respectively, each of which is connected to an opposite crib end unit, or if desired, to an opposite side unit, can be controlled simultaneously by means of a common actuator 95. Actuator 95, which is generally affixed to a crib side unit facing the interior of a room, is connected to a cable 97 extending to a splitter device 98, e.g. the Easytouch Slitter 20

SP1 manufactured by BansbachEasylift GmbH, Germany, which directs the motion imparted by cable 97 simultaneously to cables 59A and 59B. Cables 59A and 59B are coupled to valve mechanisms 66A and 66B, respectively, for controlling the displacement of piston rods 58A and 58B, respectively. A spring biased button 99 may be associated with actuator 95 for controlling the motion of the piston rods, i.e. whether to be displaced upwardly, downwardly, or to be locked in position. Alternatively, a lever, or any other release member well known to those skilled in the art, may be associated with actuator 95 in order to release the two gas springs simultaneously. A B1B-3-28/10 gas spring model manufactured by BansbachEasylift GmbH, Germany, having a stroke of 45 cm may be employed.

Figure 14:
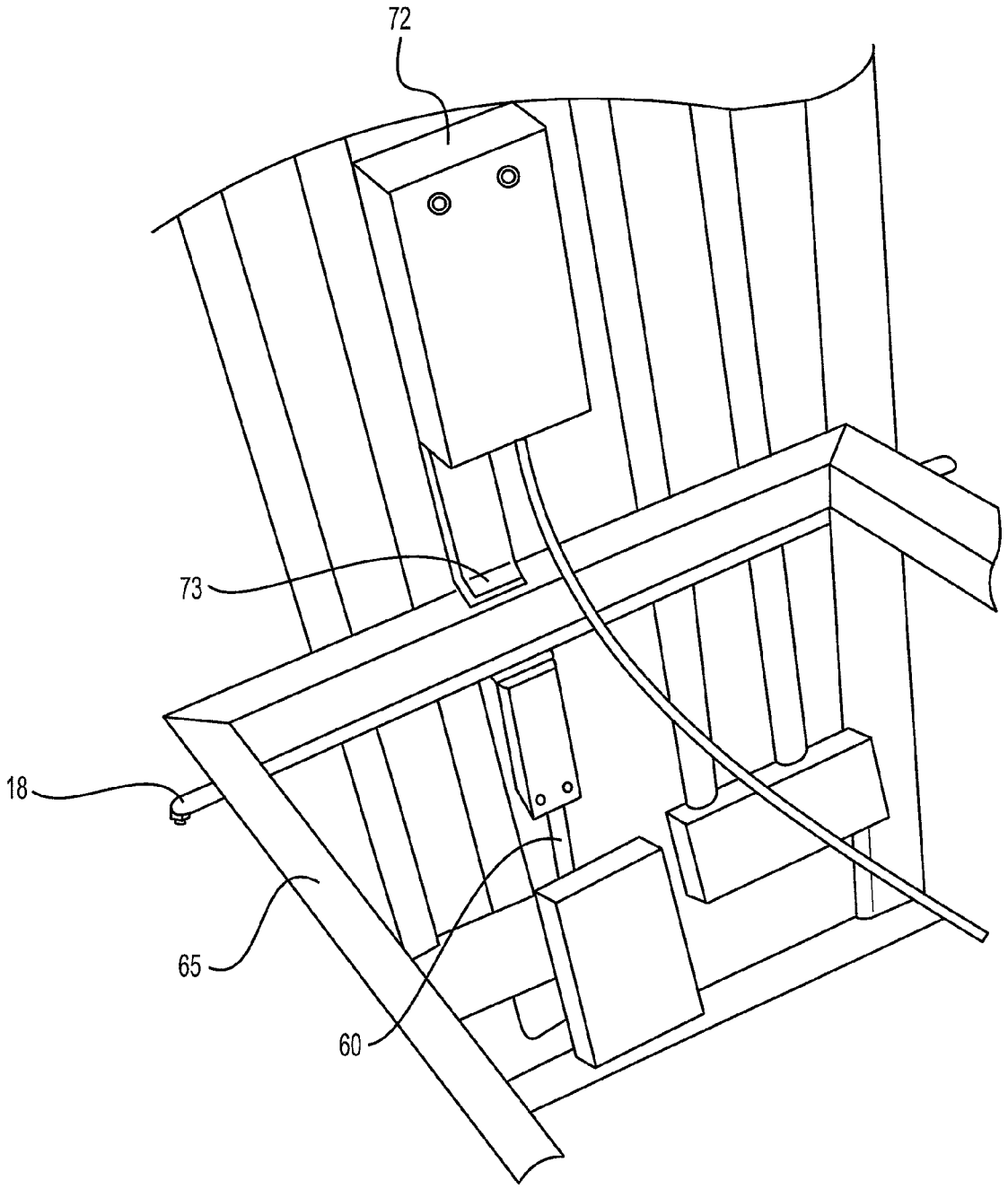
FIG. 14 is a perspective view of a crossbar of FIG. 1 attached to the underside of the frame element of FIG. 11.

A linear bearing for stabilizing the mattress support as it is displaced vertically may be employed in conjunction with any of the embodiments described hereinabove with respect to FIGS. 1-7. As shown in FIG. 14, crossbar 18 is connected to both linear bearing 60 and frame element 65.

Figure 15:
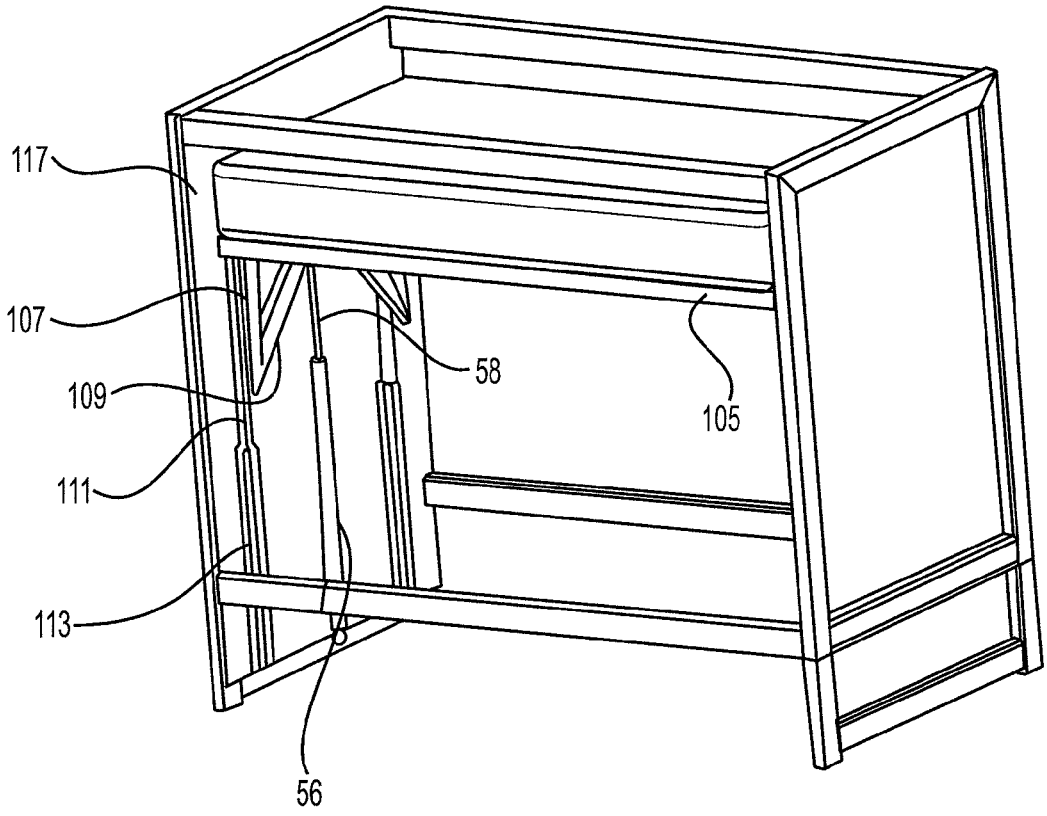
FIG. 15 is a perspective drawing of a baby crib, showing mattress support stabilization apparatus according to one embodiment of the invention while the mattress support is in an uppermost position.
Figure 16:
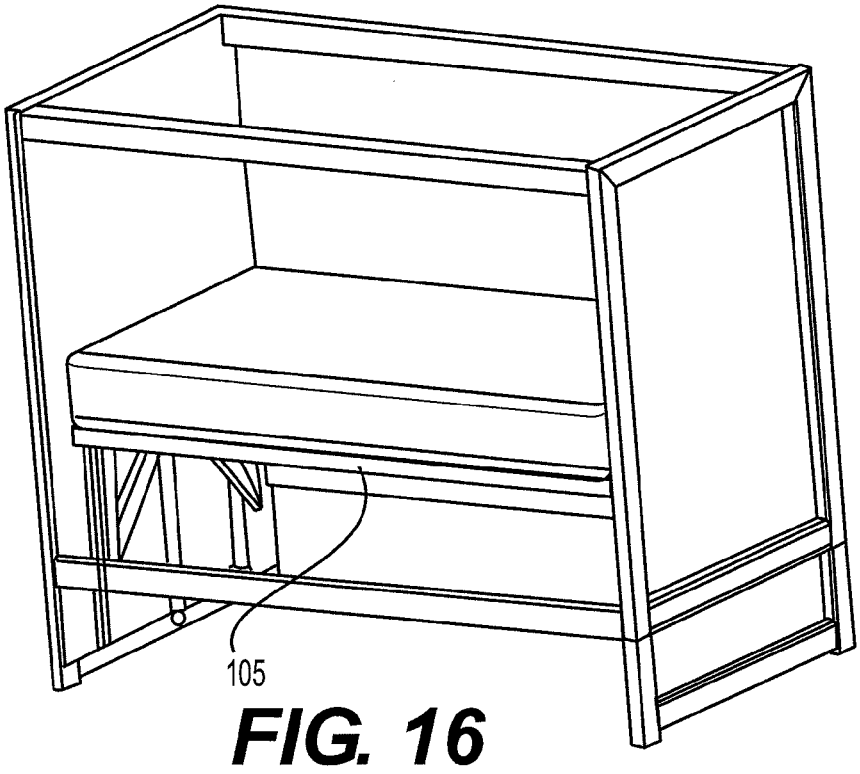
FIG. 16 is a perspective drawing of the baby crib of FIG. 15, showing the mattress support in a lowermost position.

FIGS. 15-16 illustrate another embodiment of the invention wherein a vertically oriented leg 107 of an angled element 109 protruding from the underside of mattress support 105 is fixedly attached to vertically oriented rail portion 111. Rail portion 111 is C-shaped and is provided with a plurality of ball bearings in the vicinity of its lips, so that it may be telescopically extended from, and retracted within, base rail portion 113, which has a similar profile as rail portion 111 and is attached to crib end unit 117. A gas spring 56 is attached to each crib end unit 117 and is interposed between two telescopic rail portions 111, to each of which is attached a corresponding leg 107. Piston rod 58 is connected to the underside of mattress support 105 so that the latter will be vertically displaced in response to the motion of the piston rod, whether to a raised position as shown in FIG. 15 or to a lowered position as shown in FIG. 16.

Figure 39:
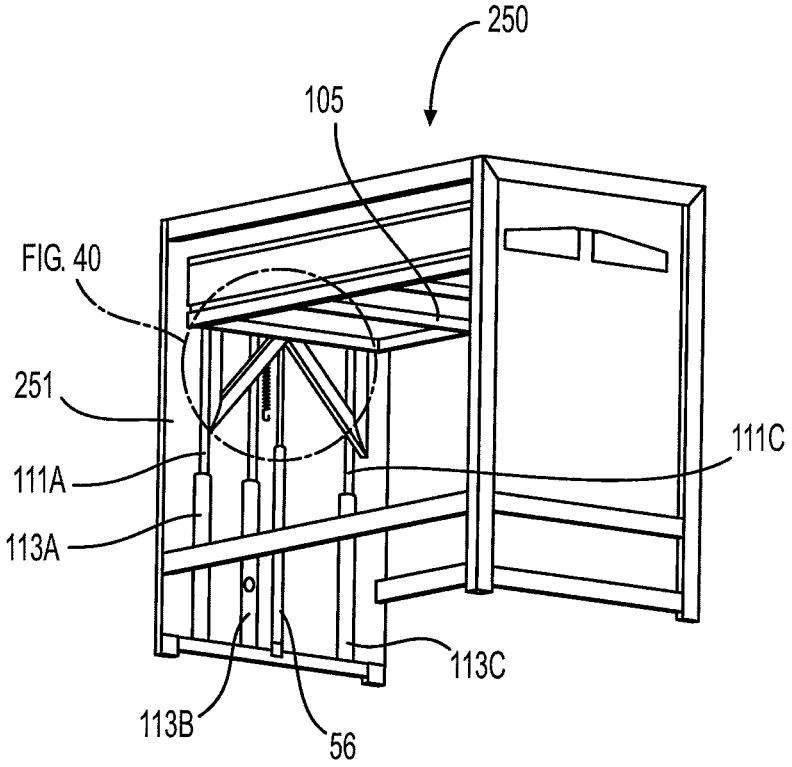
FIG. 39 is a perspective view of a baby crib, showing a spring attached to a rail portion for counteracting the weight of a baby.
Figure 40:
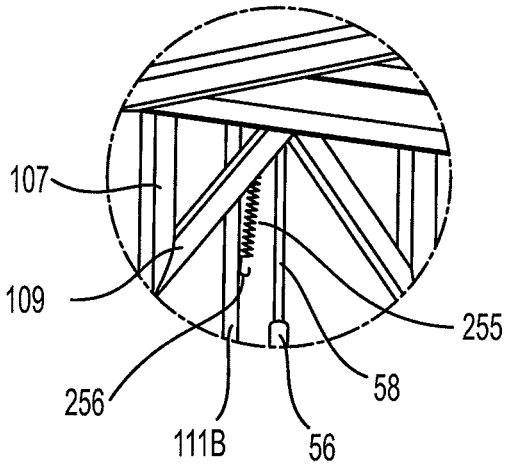
FIG. 40 is an enlarged view of FIG. 39.

In the embodiment shown in FIGS. 39-40, to each end unit 251 of crib 250 is connected three base rail portions 113A-C, from each of which is telescopically extendable one or more vertically disposed rail portions 111A-C, respectively, and a gas spring 56 such that its piston rod 58 is connected to the underside of mattress support 105. Vertically oriented leg 107 of an angled element 109 protruding from the underside of mattress support 105 is fixedly attached to a corresponding vertically oriented rail portion 111 of base rail portions 113A and 113C. A spring 255 is attached at one end to mattress support underside 105 and at the other end to rail portion 111B, in order to counteract the weight of the baby and to thereby reduce the required force applied by gas spring 56. End 256 of spring 255 may be attached to different regions within rail portion 111B as the weight of the baby increases. If so desired, a replaceable counterweight may be used in lieu of the spring.

Figure 17:
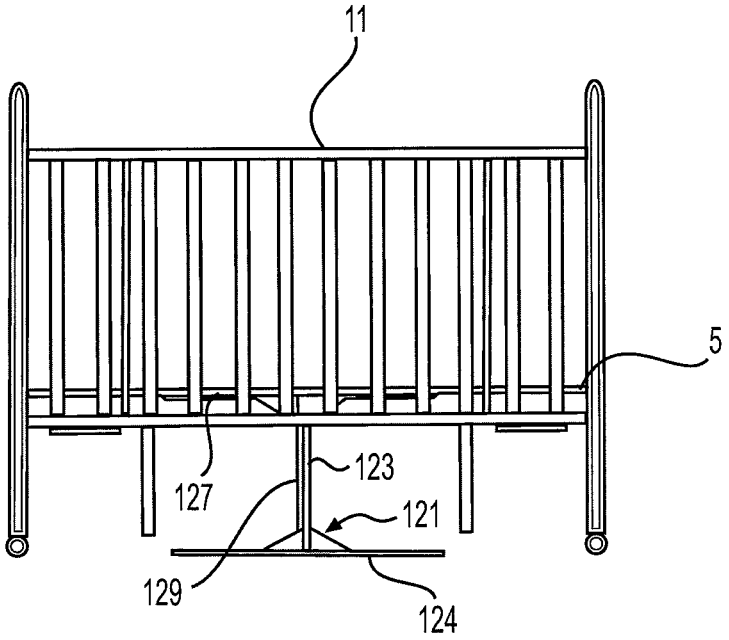
FIG. 17 is a side view of a baby crib to which is connected a drive unit according to another embodiment of the invention, showing the mattress support in a lowermost position.
Figure 18:
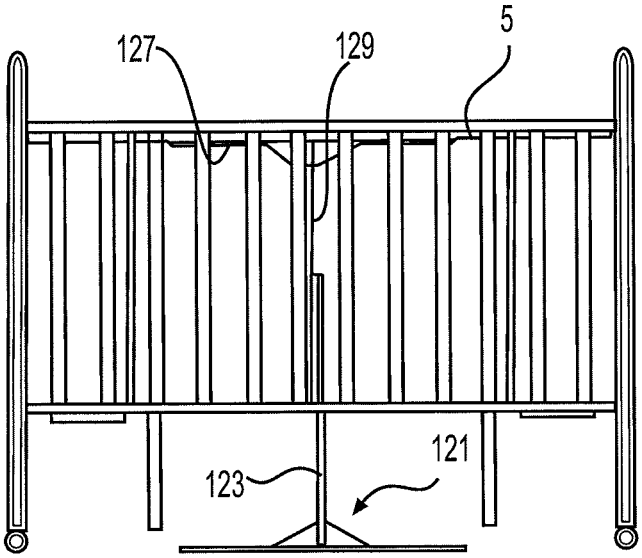
FIG. 18 is a side view of a baby crib to which is connected the drive unit of FIG. 17, showing the mattress support in an uppermost position.
Figure 19:
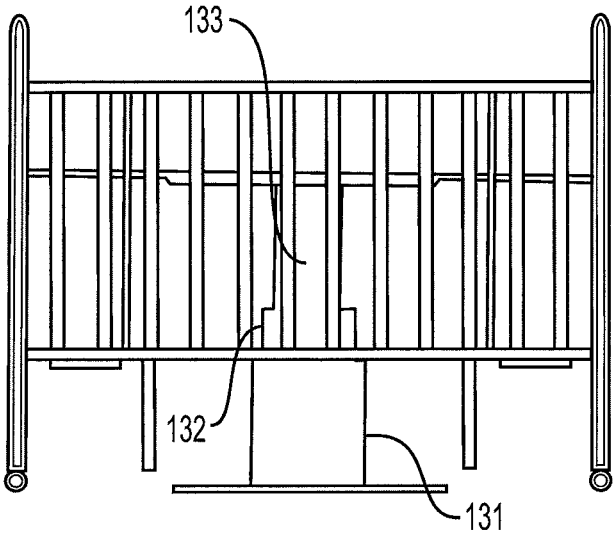
FIG. 19 is a side view of a baby crib to which is connected the drive unit of FIG. 17 covered by a three staged casing, showing the mattress support in an intermediate position.

FIGS. 17-19 illustrate another embodiment of the invention wherein mattress support 5 is continuously height adjustable by means of a telescopic piston unit 121. Piston unit 121, which may be hydraulically, pneumatically, or electrically actuated, has a planar base 124 placed on a floor surface to which is connected a first vertically oriented leg 123. A planar abutting member 127 to which is connected a second vertically oriented leg 129 is attached to the underside of mattress support 5. Second leg 129 is coupled to first leg 123 by a grooved connection. Alternatively, second leg 129 is fixedly coupled to first leg 123, and legs 123 and 129 may be simultaneously extendable. One piston unit 121 may be employed, being centered under mattress support 5, or two piston units may be employed, each of which being positioned adjacent a corresponding side unit 11. FIG. 17 shows mattress support 5 in its lowermost position, while FIG. 18 shows it in its uppermost position. FIG. 19 illustrates a three-staged casing 131-133 for the piston unit, so that at any height between the lowermost position and the uppermost position as shown, legs 123 and 129 may be locked in place.

FIGS. 20-37 illustrate one embodiment of a locking device 140 for preventing displacement of the mattress support following the inadvertent pressing of the release member of the drive unit actuator. A retractable ore removable pin 221 (FIG. 33), or any other releasable engagement means well known to those skilled in the art, normally locks the drive unit actuator, and only when a disengagement device is actuated as will be described hereinafter, the pin is released and the actuation of the drive unit is made possible.

Figure 20:
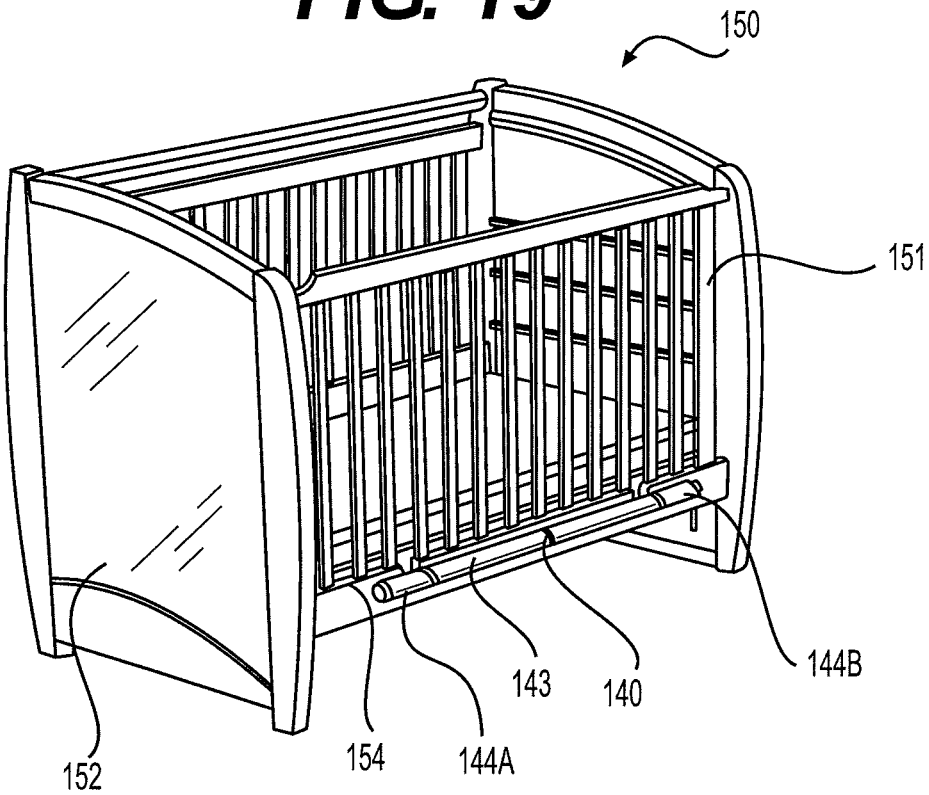
FIG. 20 is a perspective view of a baby crib, showing a locking device in a retracted position.

As shown in FIG. 20, locking device 140 comprises a horizontally oriented bar 143 interposed between two grips 144A and 144B. Grip 144A serves as the means for disengaging the pin from the drive unit actuator. Grip 144B serves as the means for actuating the drive unit. Bar 143 is illustrated in a retracted position with respect to side unit 151 when mattress support 154 is in a lowered position. Prior to disengaging the pin from the drive unit actuator, mattress support 154 is prevented from being vertically displaced. As bar 143 is not readily visible to a curious baby, accidental actuation of the pin release actuator or of the drive unit actuator is substantially impossible.

Figure 21:
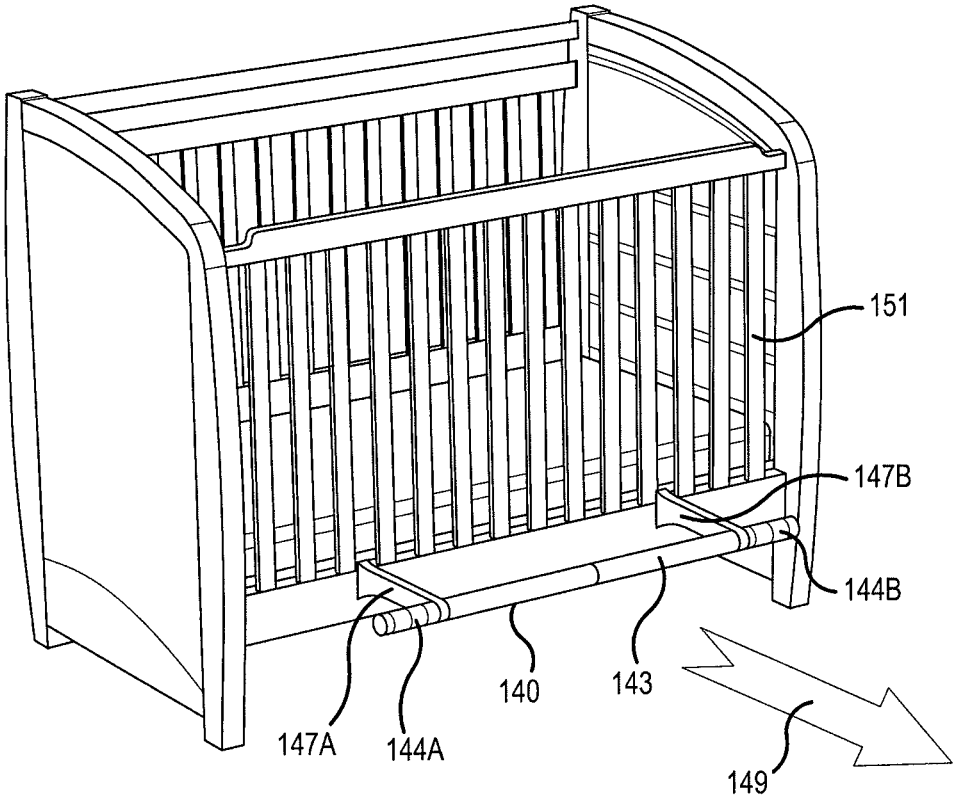
FIG. 21 is a perspective view of the baby crib of FIG. 20, showing the locking device of FIG. 20 in an extended position.

In FIG. 21, bar 143 is shown in an extended lowered position with respect to side unit 151. Bar 143 is brought to an extended position by pulling on grips 144A and 144B in the direction indicated by arrow 149. Arms 147A and 147B are fixed to, and extend inwardly from, grips 144A and 144B, respectively. Arms 147A and 147B may be made of plastic or of metal, and may be integrally fixed to grips 144A and 144B, respectively.

Figures 22, 23:
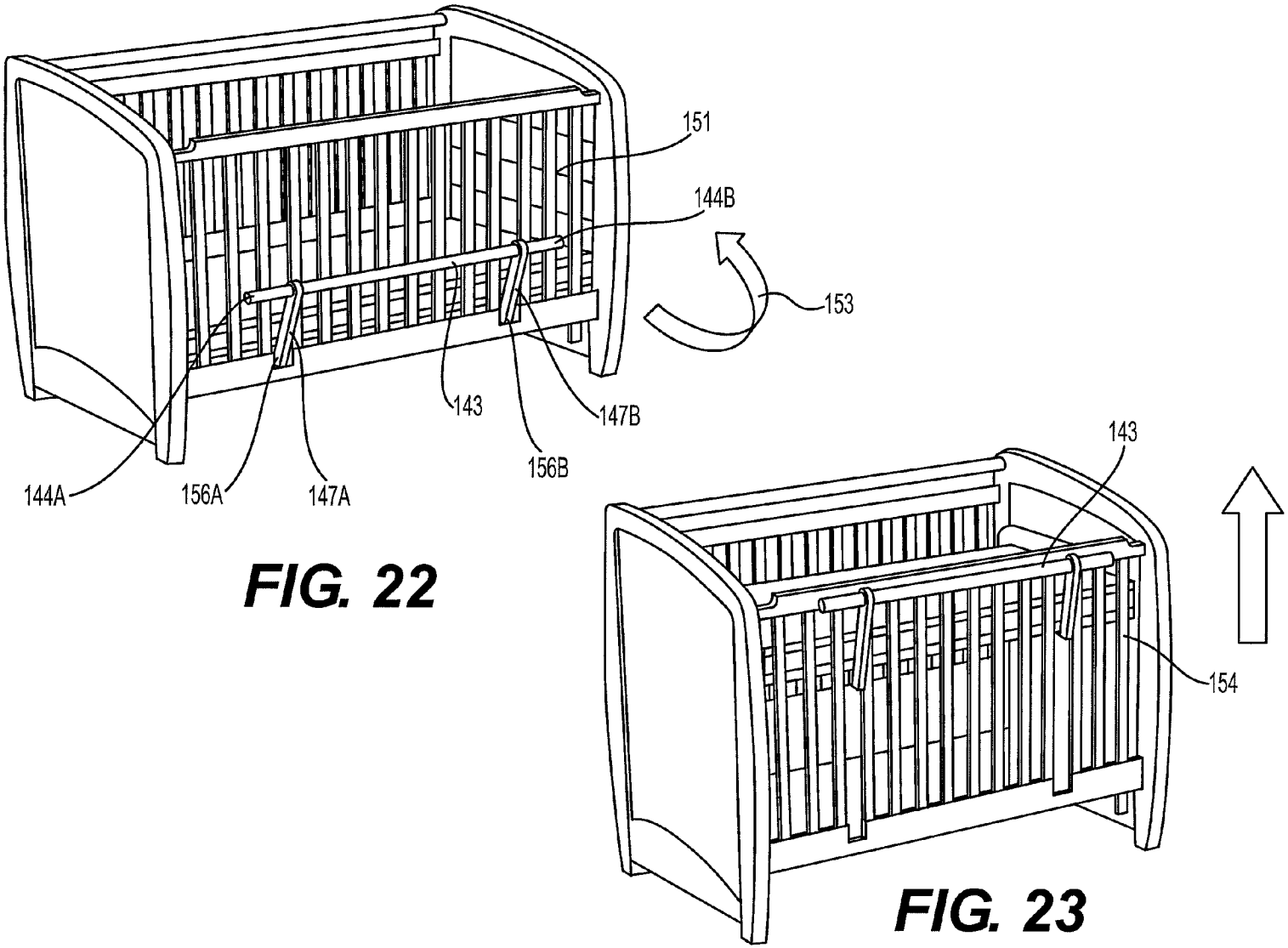
FIG. 22 is a perspective view of the baby crib of FIG. 20, showing the locking device of FIG. 20 in an upwardly rotated position.
FIG. 23 is a perspective view of the baby crib of FIG. 20, showing the locking device of FIG. 20 in an upwardly rotated position while the mattress support is in a raised position.
Figure 32:
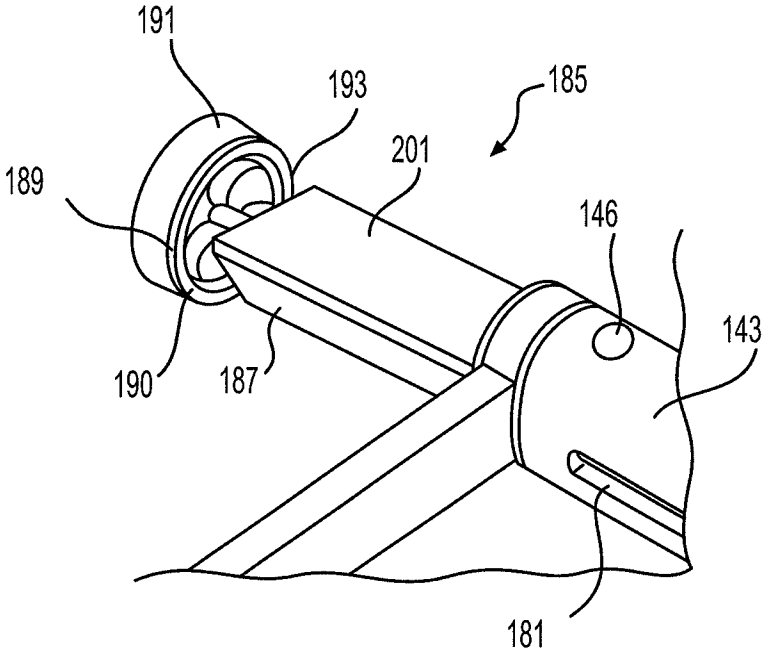
FIG. 32 is a perspective view of the drive unit actuator framework.

In FIG. 22, bar 143 is shown to be in an upwardly rotated position, in order to simplify the actuation of the pin release actuator and of the drive unit actuator without having to bend to the lowermost portion of end unit 151. When arms 147A and 147B are pivoted with respect to grooved units 156A and 156B, respectively, by applying a force to grips 144A and 144B in the direction indicated by arrow 153, bar 143 is able to be upwardly pivoted. Bar 143 remains in the upwardly rotated position when mattress support 154 is upwardly displaced, as shown in FIG. 23. If so desired, bar 143 can be fixed in a downwardly rotated position.

An exemplary configuration of grooved unit 156 is illustrated in FIGS. 24-30. As shown, grooved unit 156 is substantially rectangular, and has planar top edge 162, bottom edge 172, and outer edges 157 substantially perpendicular to edges 162 and 172. Grooved unit 156 is formed with a through-hole, variably shaped guide groove 158. Guide groove 158 has an elongated central portion 159 defined by upper edge 160 and lower edge 161 parallel to upper edge 160, and an inner portion 163, i.e. positioned away from the direction of a crib side or end unit depending on the orientation of grooved unit 156, having an upper edge 165 coincident with upper edge 160 of the central portion, a lower edge 166 located above lower edge 161 of the central portion and a terminal arcuate edge 167 extending from upper edge 165 to lower edge 166. Outer portion 168 of guide groove 158 is C-shaped and has an upper edge 169 that is continuous with upper edge 160 of the central portion. Lower edge 161 of the central portion terminates with a protuberance 164 that constricts the interspace of outer portion 168. Lower edge 171 of outer portion 168 has a concave edge 173 that abruptly extends downwardly adjacent to protuberance 164.

Arm 147 is provided at end 153 thereof with circular protrusions 176 and 177 that engage with the edges of guide groove 158. When arm 147 is in an upwardly rotated position as shown in FIG. 24, larger protrusion 176 can be seated within concave edge 173 as shown in FIG. 27 to secure arm 147 at a given angle with respect to grooved unit 156. Concave portion 155 formed on the periphery of arm end 153 and which is engageable with element 175 protruding from one face of grooved unit 156 as shown in FIG. 28 can serve as an additional means to secure arm 147 at a given angle.

Protrusion 176 can serve as an axle for arm 147 when engaged with both protuberance 164 and upper edge 169 of groove outer portion 168, as shown in FIG. 29, in order to change the angle of arm 147. As arm 147 is rotated, protrusion 177 slides within groove outer portion 168. When arm 147 is in an extended position as shown in FIGS. 25 and 30, protrusion 176 engages central portion upper edge 160. Upon application of an inwardly directed force 181, protrusion 176 is displaced within central portion 159 until it is seated within inner portion 163, as shown in FIG. 26, while grip 144 contacts outer edge 157 of grooved unit 156.

Figure 37:
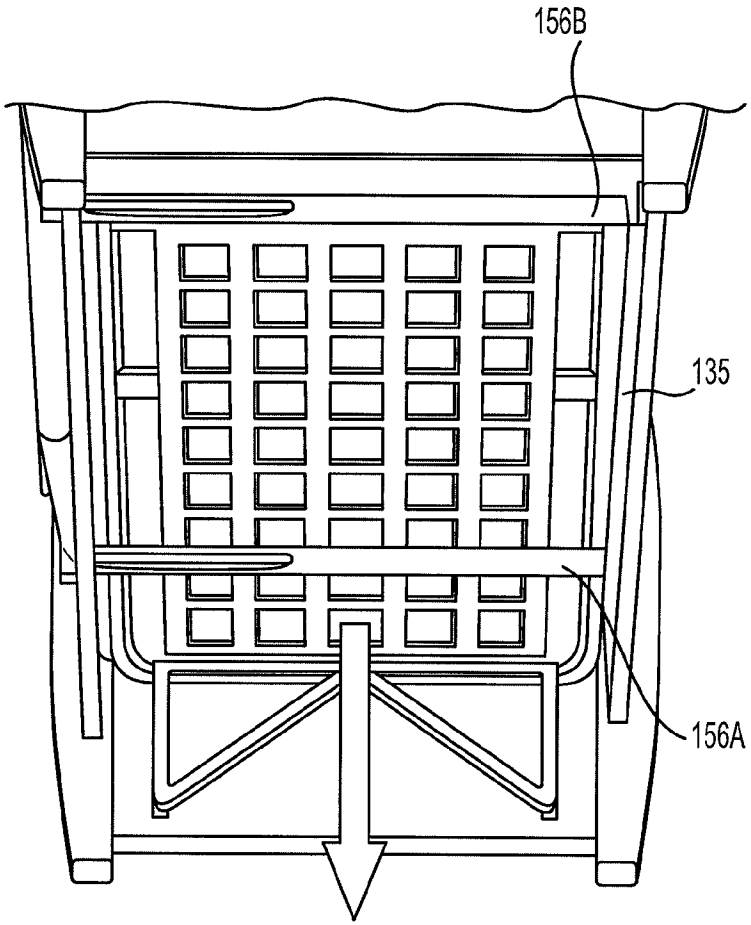
FIG. 37 is a perspective view of a mattress support underside, showing the connection of two grooved units of FIG. 24 therewith.

As shown in FIG. 37, top edge 162 (FIG. 24) of grooved units 156A and 156B is attached by any means well known to those skilled in the art to the underside of mattress support 135, which is shown in a lowered position. Outer edge 157 of the grooved units may outwardly protrude from the outer end of mattress support 135.

Figure 31:
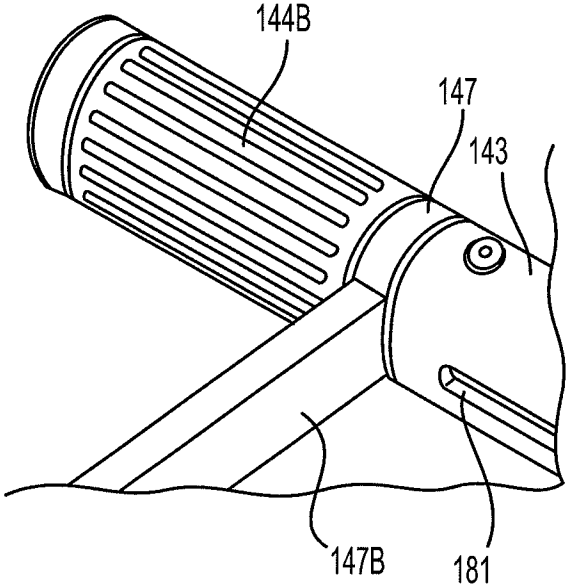
FIG. 31 is a perspective view of a rotatably mounted grip for the drive unit actuator.
Figure 34:
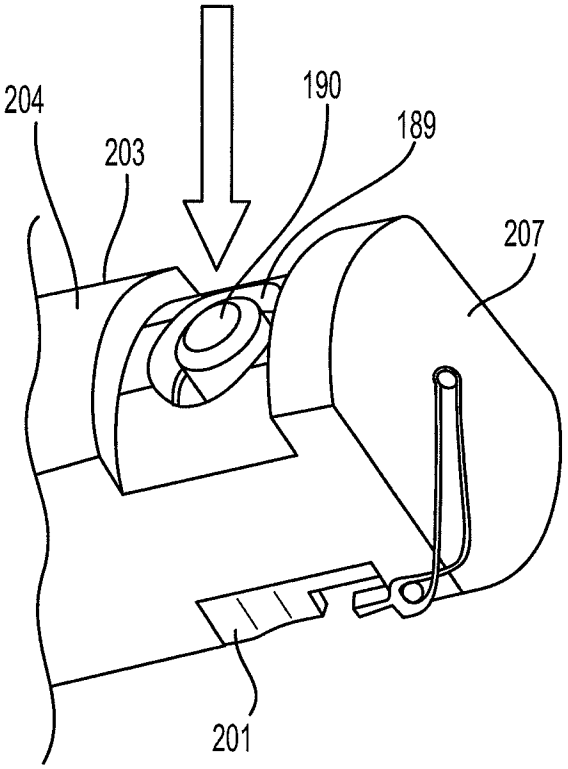
FIG. 34 is a perspective view of a drive unit actuator, according to one embodiment of the invention.

In FIG. 31, arm 147B is shown to be rotatably mounted on bar 143 by means of ring element 147 while grip 144B is rotatably mounted onto the underlying drive unit actuator framework. A longitudinal groove 181 through which a cable for disengaging the drive unit locking pin extends is formed within the periphery of bar 143.

An exemplary drive unit actuator framework 185 is illustrated in FIGS. 32-35. Framework 185 has a planar top surface 201, bottom surface 203, outer end surface 207, and inner end surface 208. In rounded side surfaces 204 and 205, each of which extending in opposite directions between surfaces 201 and 203, are formed longitudinal grooves 187 and 208, respectively, Circular end cap 191 is snapped onto outer end surface 207. Aperture 209 for mating with aperture 146 of bar 143 is bored within top surface 201 adjacent to inner end surface 208. Adjacent to outer end surface 207 within side surface 204 is formed a recess 189 in which is mounted drive unit actuator 190, e.g. a button. Cable 197 for imparting motion to the disengaging device is placed within longitudinal groove 187 provided within the periphery of framework 185 and extending from recess 189. Another recess 193 in which is seated rear side 192 of actuator 190 is formed within side surface 205. Cable 209 for imparting motion to the drive units extends in longitudinal groove 208 from recess 193.

Figure 36:
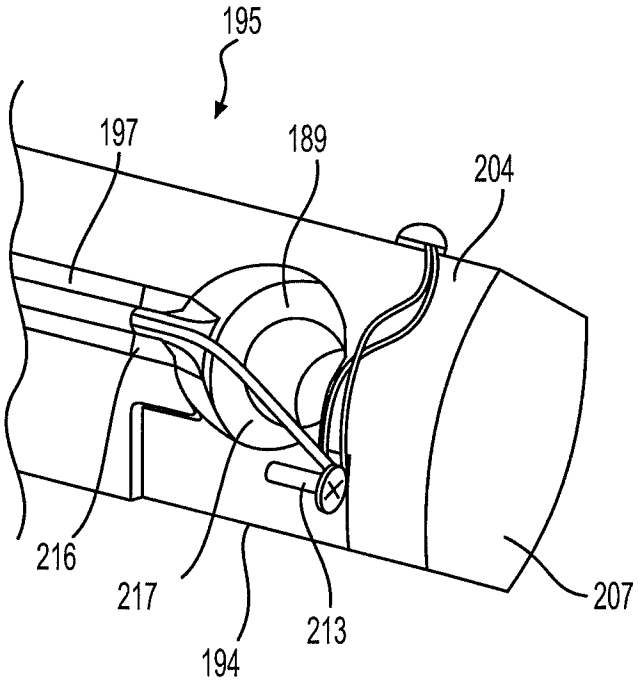
FIG. 36 is a perspective view of a disengagement device actuator framework, according to one embodiment of the invention.
Figure 35:
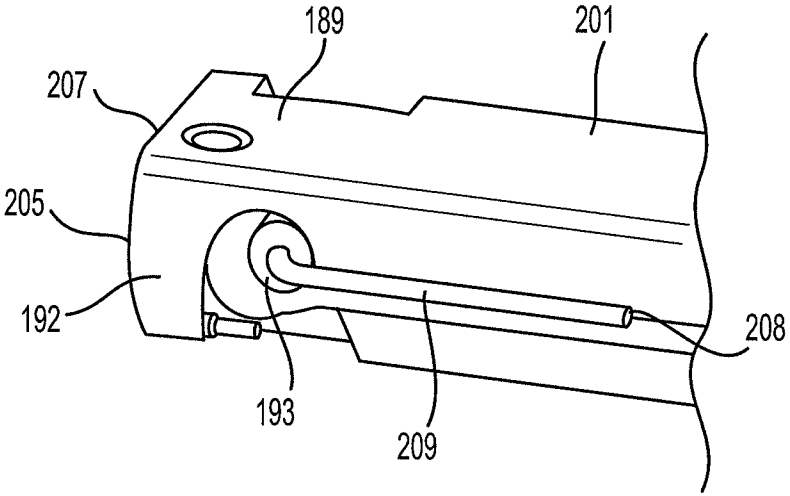
FIG. 35 is a perspective view of the drive unit actuator of FIG. 34.

An exemplary pin release actuator framework 195 is illustrated in FIG. 36. Pin release actuator framework 195 is configured similarly to the drive unit actuator framework, and has a planar top surface, bottom surface, outer end surface, and inner end surface and rounded side surfaces. A recess 194 is formed in side surface 204 of pin release actuator framework 195, and connector 213, e.g. a screw, for connecting grip 144A (FIG. 21) to framework 195 is fixedly mounted within recess 194. A cable guide 216 is formed in side surface 204 of framework 195 adjacent to recess 189, and cable 217 attached to connector 213 is fed through cable guide 216 and combined with disengagement cable 197. Accordingly, when grip 144A, which is rotatably mounted about framework 195, is rotated, disengagement cable 197 is urged towards outer end surface 207.

Figure 33:
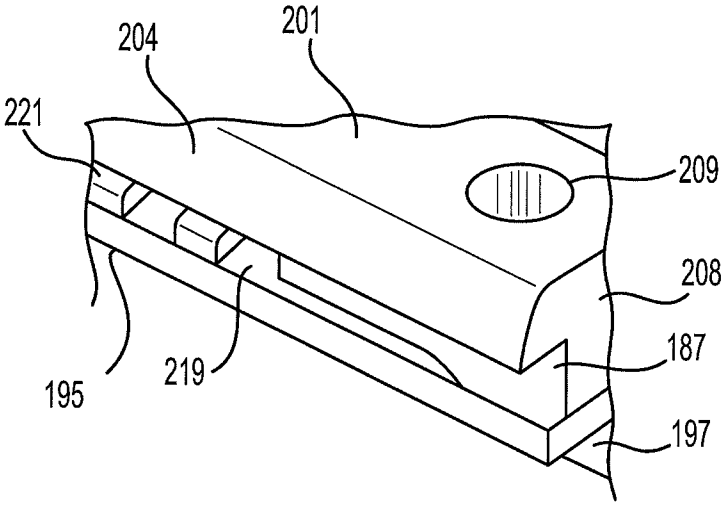
FIG. 33 is a perspective view of a disengagement device, of FIG. 32, inserted within a groove formed within the drive unit actuator framework.

The disengagement device, which may be a transversally displaceable stopper 195, is illustrated in FIG. 33. The thickness of stopper 195 is substantially equal to the vertical dimension of the cavity within groove 187. A longitudinally oriented aperture is bored within stopper 195, and secondary cable 219 extending from disengagement cable 197 passes through stopper 195 via the aperture and is connected with schematically illustrated pin 221 that locks the drive unit actuator. Upon rotation of grip 144A (FIG. 21), stopper 195 is transversally displaced towards pin release actuator framework 195 (FIG. 36) and pin 221 is released from a drive unit actuator assembly to permit operation of the drive unit actuator. When drive unit actuator 190 (FIG. 34) is depressed following rotation of grip 144B, motion is imparted to the drive units by means of cable 209 shown in FIG. 35 as well known to those skilled in the art. Alternatively, the drive unit actuator may be operated without need of rotating grip 144B, such as by depressing a button.

Figure 38:
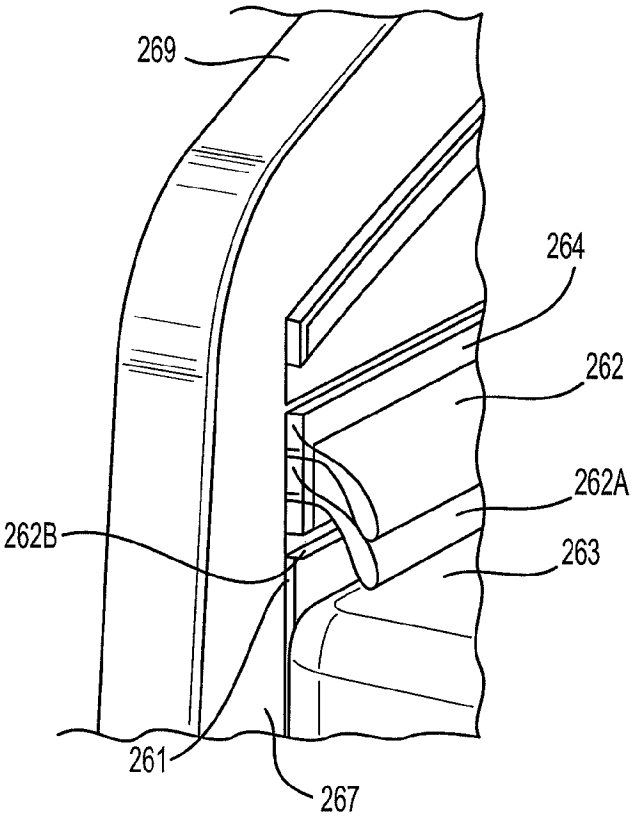
FIG. 38 is a perspective view of a crib unit, showing a plurality of curtain elements.

FIG. 38 illustrates curtain elements 262 that are used to cover each rail portion or any other apparatus associated with the crib, for added protection of a baby located on mattress 263. A plurality of horizontally disposed cross members 264, e.g. of a rectangular profile, are slidingly engageable within a vertical track formed within two opposing posts 267 of each crib end unit 269. Posts 267 are sufficiently thick so that the tracks in engagement with cross members 264 are provided at an inward portion thereof, while the rails covered by the curtain elements are provided at an outward portion thereof. An upper curtain portion 262A is affixed to the bottom surface of a first cross member 264 and a lower curtain portion 262B is affixed to the top surface of a second cross member immediately below the first cross member. When the mattress support is located at a lower position, adjacent cross members 264 are separated and curtain elements 262 are able to cover each rail portion. When the mattress support is located at a higher position, vertically oriented plate 261, which may be connected to the mattress support, contacts the lowermost cross member 264 and urges the curtain element 262 affixed thereto to be compressed.

Figure 42:
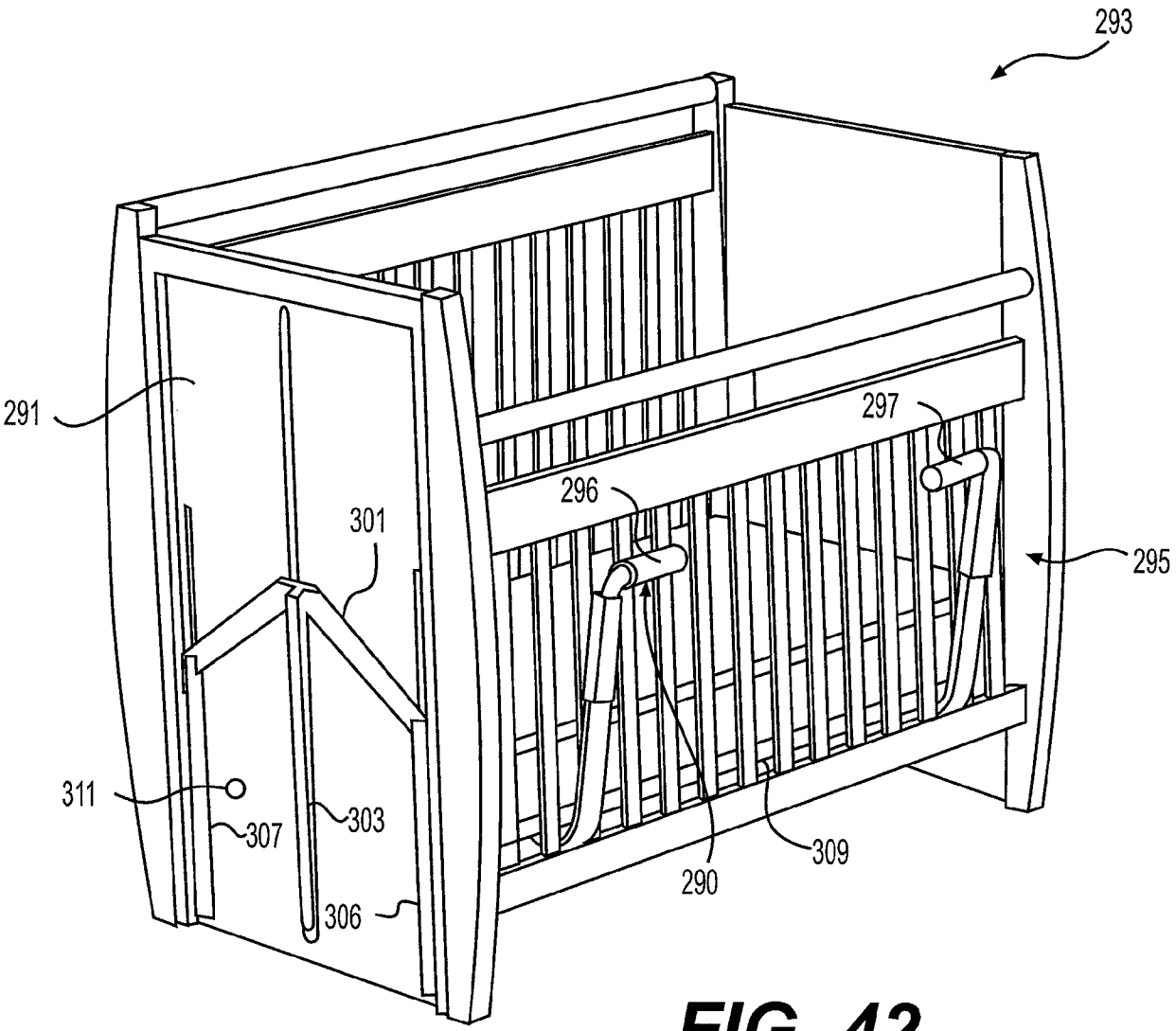
FIG. 42 is a perspective view of a baby crib, showing another embodiment of a locking device and of a stabilizing device.

Another embodiment of a locking device is illustrated in FIG. 42. Crib 293 comprises pin release actuator 290, which is separate from drive unit actuator 295. Pin release actuator 290 and drive unit actuator 295 have pivotal ends 296 and 297, respectively, by which operation of the corresponding actuator is initiated. In this embodiment, pin 311, which is schematically illustrated, normally engages mattress support 309 with end unit 291 of crib 293, to prevent vertical displacement of mattress support 309 following inadvertent actuation of the drive units. When pivotal end 296 of pin release actuator 290 is rotated, pin 311 is disengaged from end unit 291, whereupon operation of drive unit actuator 295 is made possible.

End unit 291 has an integral drive unit and rail. Vertically oriented rails 306 and 307 and drive unit 303, which is interposed between rails 306 and 307, are attached to V-shaped bracket 301 such that each rail is attached to a corresponding leg and the drive unit is attached to the centerline of the bracket. Rails 306 and 307 may be telescopically expandable.

Figure 43:
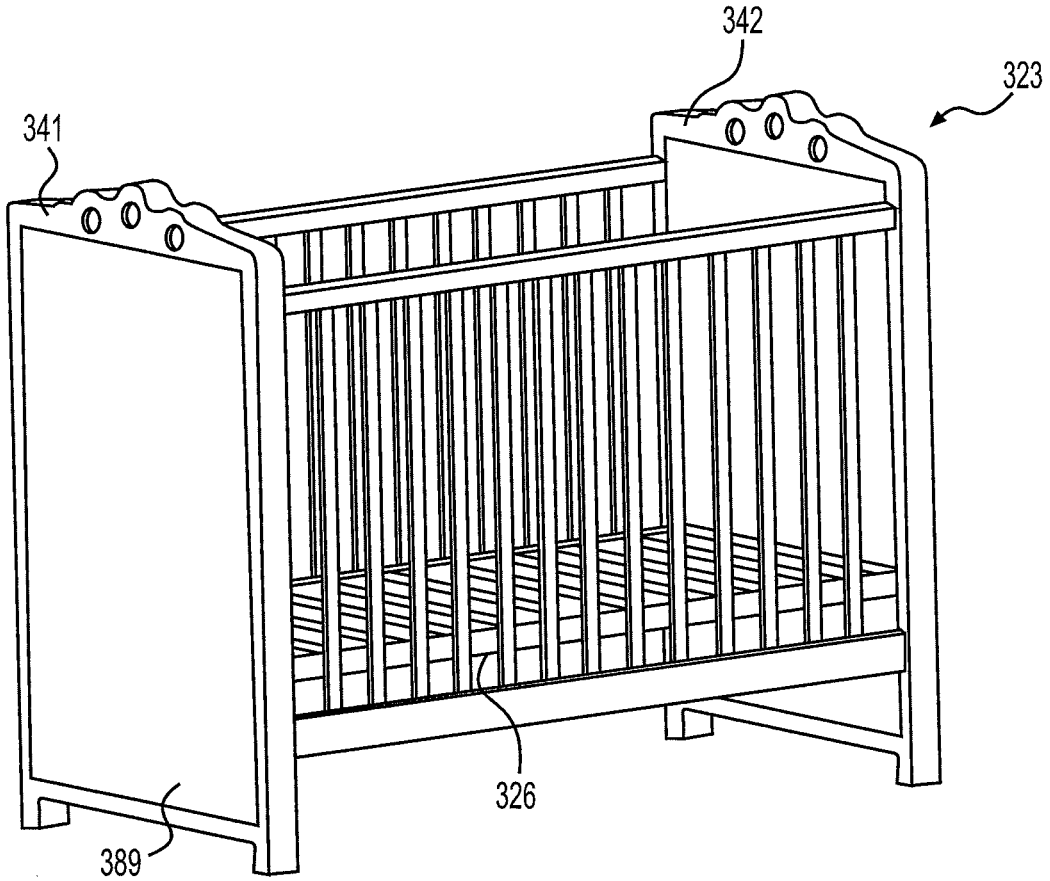
FIG. 43 shows a perspective view of a baby crib, according to other embodiments of the invention having a continuous height adjustment mattress support mechanism concealed in this view by cover plates.
Figure 44:
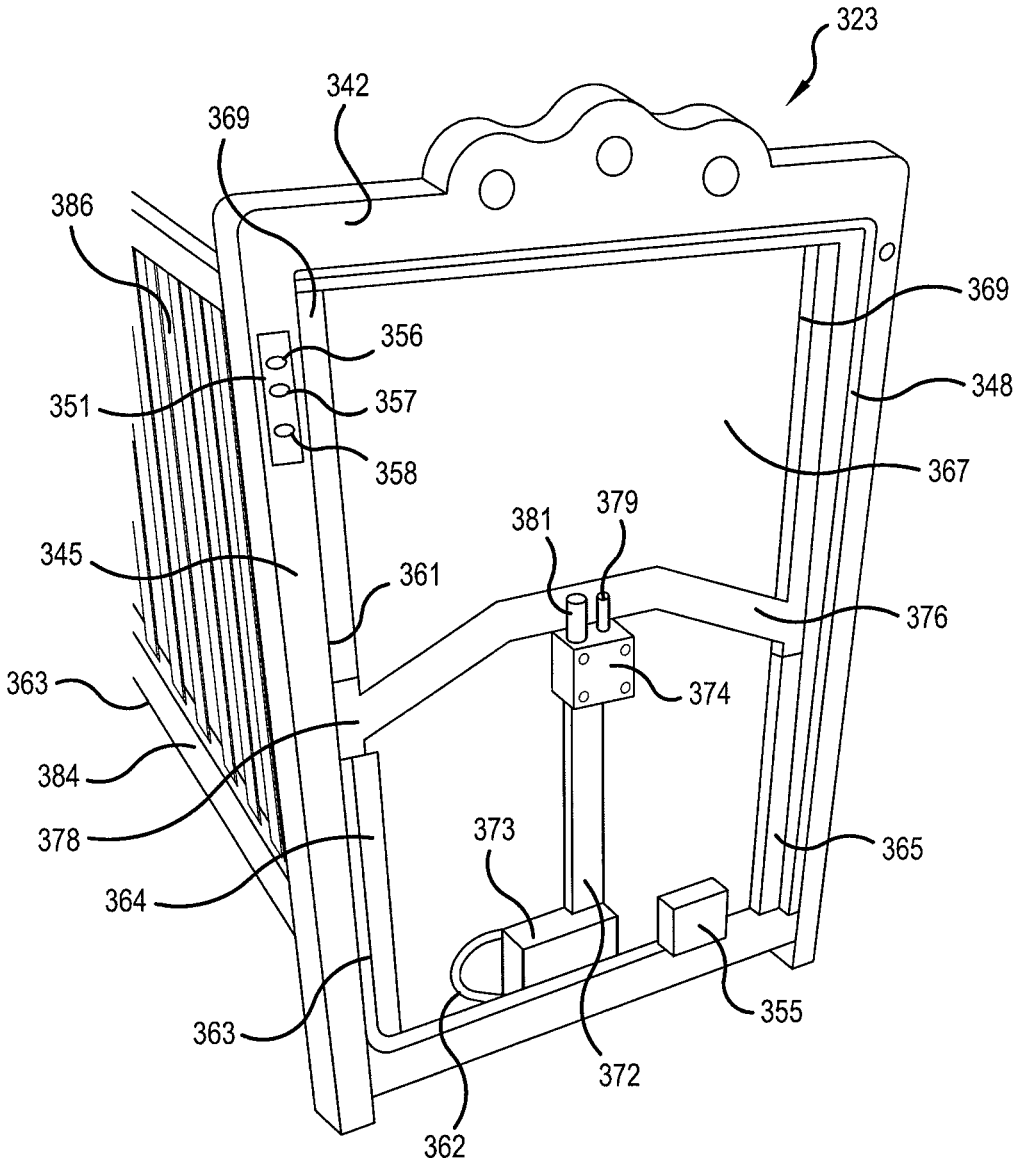
FIG. 44 shows the baby crib and height adjustment mattress support including a locking device for preventing inadvertent operation thereof without the cover plate concealing thereof, according to some embodiments of the invention.
Figure 45:
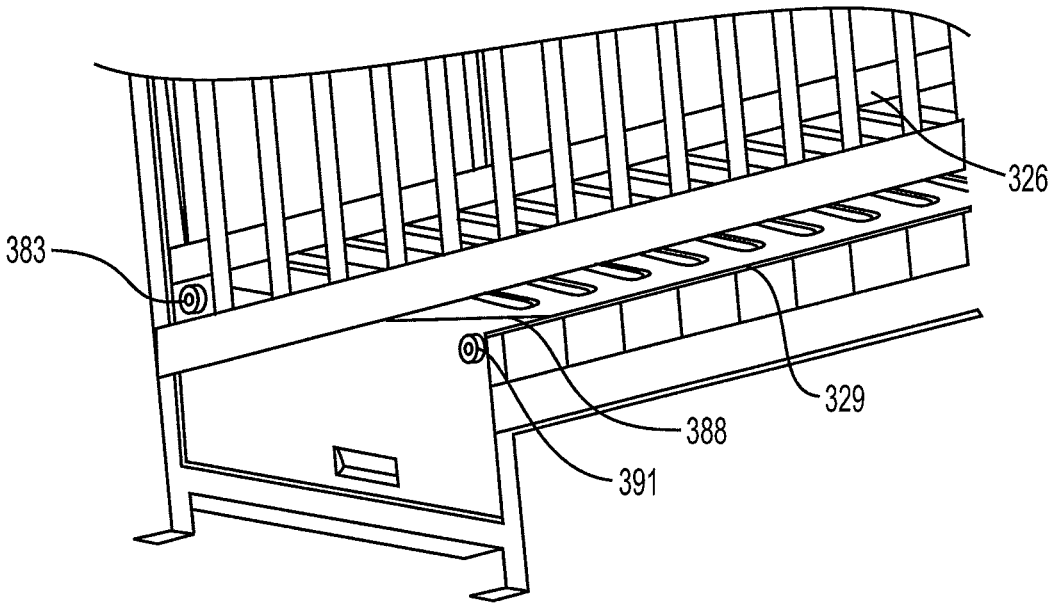
FIG. 45 shows a isometric view of the height adjustable mattress support of FIG. 44, according to some embodiments of the invention.

Reference is now made to FIGS. 43-45, schematically illustrating a baby crib 323 having a continuous height adjustment mattress support mechanism combined with a locking device 351 for preventing inadvertent lifting or lowering of a mattress support 326 of this mechanism, according to some embodiments of the invention. The height adjustment mattress support mechanism includes: (i) the mattress supper 326; (ii) a drive unit including a piston 379 operable by a piston motor 373; (iii) a driven component including one or more brackets such as V-shaped bracket 376 that is displaceable by the piston 379; and (iv) a control box actuator 355.

According to some embodiments, as illustrated in FIG. 44, the control box 355 connects to the locking device 351 and to the piston motor 373 through cables 361 and 362 respectively to allow it to receive signals (e.g. electrical signals) from the locking device 351 and operate the piston 379 according to the received signals.

According to some embodiments, the V-shaped bracket 376 engages the mattress support 326 (e.g. by directly or indirectly connecting thereto) to allow it to vertically displace it (i.e. lower and lift it) upon actuation of the piston 379.

The locking device 351 includes a control panel allowing a user to both adjust the height of the mattress support 326 by vertically displacing thereof and also includes a disabling function that allows the user to set it to a disabling state in which it allows disabling the piston motor 373 preventing it from operating by cutting off its power supply the disabling function of the control panel also allows the user to re-enable the height adjustment by retrieving power supply. For example, the locking device 351 includes three control buttons: a lowering button 356, a lifting button 358 and a disabling button 357. The lowering and lifting buttons 356 and 358 allow the user to lower or lift the mattress support 326 by continuously pressing thereof. The disabling button 357 allows disabling the piston motor 373 by pressing thereof and re-enabling the operation of the piston motor 373 by pressing this button 357 again.

The disabling is carried out, according to some embodiments, by sending a signal to the control box 355 for switching off a designated switch in the control box 355 that allows disconnecting electrical power supply to the piston motor 373, were re-enabling height adjustment is carried out by switching back on.

According to some embodiments, the lowering and lifting buttons 356 and 358 connect to the control box 355 through one wire and the disabling button 357 connects to the control box 355 through a different wire.

In these embodiments cable electric signaling is used. However, other signaling methods and configurations may be used to control and actuate the piston motor 373 such through wireless communication based on RF or optical signaling, for example.

According to some embodiments, as illustrated in FIG. 44, the piston 379 is protected by a casing cover sleeve 372 preventing it from tilting sideways for allowing it only to move in a vertical direction upwards and downwards. A mounting box 374 may be attached to the sleeve 372 to further protect the sleeve 372 from tilting sideways by also connecting it to a support plate 367 attachable to the end unit 342.

According to some embodiments, as illustrated in FIG. 44, the V-shaped bracket 376 can be vertically displaced by the piston 379 by being vertically movable along two rails 364 and 365 each disposed over a different side of the crib 323 end unit 342. The rails 364 and 365 may be etched over the sides of the end unit 342 or installed thereover. In this particular example, illustrated in FIG. 44, the rails 364 and 365 are part of a frame 345 installed over the end unit 342 also configured for receiving a cover plate 389 that covers the entire mechanism for both safety and esthetical purposes. In this case, only the control panel of the locking device 351 is uncovered to allow the user to access it. The cover 389 is mounted to the end unit 342 of the crib 323 via a connecting member 348, which may be a protrusion mounted to the end unit 342 configured for being inserted into a designated recess of the inner side of the cover 389.

According to some embodiments, the control panel includes a digital device having a screen and an input device (which could be combined to a touch screen based device) for digitally controlling the piston motor 355. Optionally, the locking device and the actuator are combined into a single device including a control panel and a controller box that can control and operate the piston motor or any other drive unit type.

The continuous height adjustment mattress support mechanism may also include a support plate 367 that attaches to the frame 345 configured for being attached to the end unit 342 for allowing adjusting the positioning of the entire mechanism thereover thereby defining upper and lower limits of the support mattress 326.

According to some embodiments, the rails are configured to be extendable. For example, each of the rails 364 and 365 is telescopically extendible, allowing thereby adjusting its length for determining the maximal range between the minimum and maximum height of the mattress support 326.

The piston 379 may be of any type known in the art such as pneumatic piston enabling lifting and lowering via air pressure control therein; spring based piston and the like. The motor 373 thereof is configured for converting electrical power into mechanical operation thereof. The piston 379 connects to the centerline of the V-shaped bracket 376 via a connector 381, designed to attach to the piston 379 (i.e. to the plunger) allowing it to be vertically displaced thereby.

The v-shaped bracket 376 may connect to the mattress support 326 via one or more connectors such as connectors 383, as illustrated in FIG. 45. Each connector 383 connects to a different edge of the V-shaped bracket 376 and protrudes from an inner side of the end unit 342 such that it can hold the mattress support 326 from below either by having the mattress support simply placed thereover or by directly connecting it thereto.

A substantially horizontal corner element 388 connects to the bottom edge 329 of two adjacent sides of the mattress support 326, and a vertical element 391 extending downwardly from corner element 388 is attached to connector 383. Since each connector 383 protrudes from a corresponding groove 369, the lowermost position of the mattress support 326 is influenced by the height at which the connector 383 contacts the lowermost edge of the groove 369.

Figure 46:
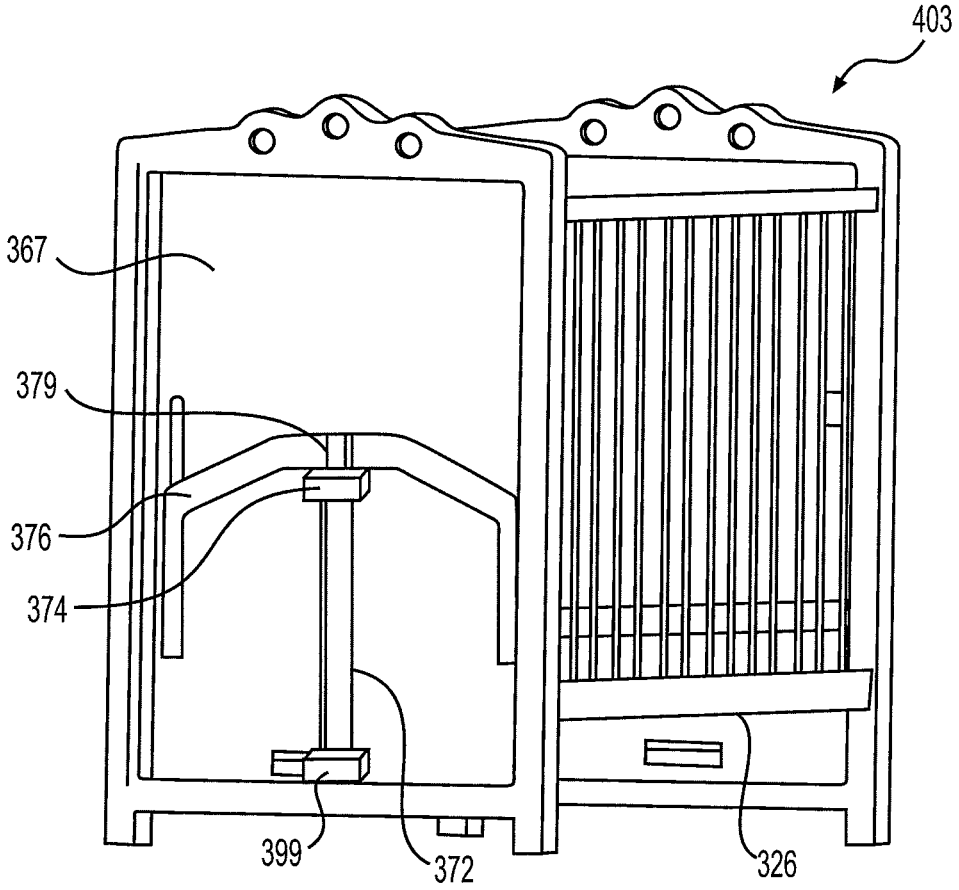
FIG. 46 shows a perspective view of a height adjustable mattress support, according to other embodiments of the invention.

FIG. 46 shows a crib 403 with a continuously height adjustable mattress support 326, which is vertically displaceable thereover via a single electrically actuated drive unit for each end unit of the crib 403 requiring no additional stabilizing means. Each drive unit is housed by a housing 372 mounted on a plate 367. An inverted V-shaped bracket 376 connects to a vertically displaceable driven piston 379 of the driven unit, which protrudes from the housing 372. The V-shaped bracket 376 also connects to the mattress support 326 via connecting elements protruding from a groove of plate 367. Upper and lower protrusions of the housing 372 are anchored via mounting boxes 374 and 399 for preventing motion of the housing 372 in four degrees of freedom: vertically laterally, between the two leg posts of the end unit, transversally towards the opposing end unit and also rotatably about the axis of the housing 372. Since the housing 372 is anchored by the two boxes 374 and 399, they efficiently absorb torque, tilt and other forces applied by the baby/toddler standing or sitting inside the crib 403, requiring no additional stabilizing means. Any other type of anchoring means can be used to stabilize the housing 372.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A system for continuous height adjustment of a mattress support in a baby crib, said system comprising:

a) at least one driven component engaging said mattress support;

b) at least one drive unit configured for applying a vertical force to said driven component for continuous vertical displacement thereof, said at least one drive unit comprises at least one piston operable by said actuator, each said piston engages said driven component to allow continuous vertical displacement thereof;

c) at least one actuator associated with said at least one drive unit for operating thereof to allow continuous adjustment of a height of said mattress support above a floor surface; and d) at least one locking device configured for preventing displacement of said mattress support in a releasable manner by disabling and re-enabling said at least one actuator, respectively.

2. The system according to claim 1, wherein said actuator comprises a control box configured to communicate with said locking device and to operate said at least one drive unit according to signals received form said locking device, said locking device further includes a control panel for enabling a user to control displacement of said mattress support and disabling of said actuator through a single panel unit.

3. The system according to claim 2, wherein said control box connects to said control panel of said locking device and to said at least one drive unit to allow operating each said drive unit according to electric signals received form said control panel.

4. The system according to claim 1, wherein said at least one driven component comprises at least one bracket connected to said at least one piston allowing thereby to be vertically displaced thereby, said bracket are movable between two rails in the crib.

5. The system according to claim 4, wherein said rails are attachable to said crib and are telescopically extendable.

6. The system according to claim 1, wherein said locking device comprises a disabling button for disabling said at least one actuator by cutting off electric power supply thereto.

7. The system according to claim 1 further comprising at least one stabilizing means engaging said at least one drive unit for stabilizing the vertical displacement of said mattress support.

8. The system according to claim 1, wherein said actuator comprises a bar and said locking device comprises at least one retractable pin that engages said bar, wherein said pin is arranged to hold said bar between grips that hold said mattress support for preventing vertical displacement thereof.

9. A baby crib comprising:

a) a crib structure having multiple leg posts;

b) a substantially horizontal mattress support configured for horizontally supporting a mattress in a baby crib;

c) at least one driven component engaging said mattress support;

d) at least one drive unit configured for applying a vertical force to said driven component for continuous vertical displacement thereof, said at least one drive unit comprises at least one piston operable by said actuator, each said piston engages said driven component to allow continuous vertical displacement thereof;

e) at least one actuator associated with said at least one drive unit for operating thereof to allow continuous adjustment of a height of said mattress support above a floor surface; and f) at least one locking device configured for preventing displacement of said mattress support in a releasable manner by disabling and re-enabling said at least one actuator, respectively.

10. The baby crib according to claim 9, wherein said actuator comprises a control box configured to communicate with said locking device and to operate said at least one drive unit according to signals received form said locking device, said locking device further includes a control panel for enabling a user to control displacement of said mattress support and disabling of said actuator through a single panel unit.

11. The baby crib according to claim 10, wherein said control box connects to said control panel of said locking device and to said at least one drive unit to allow operating each said drive unit according to electric signals received form said control panel.

12. The baby crib according to claim 9, wherein said at least one driven component comprises at least one bracket connected to said at least one piston allowing thereby to be vertically displaced thereby, said bracket is movable between two rails in the crib.

13. The baby crib according to claim 12, wherein said rails are attachable to said crib and are telescopically extendable.

14. The baby crib according to claim 9, wherein said actuator is electrically operated and said locking device comprises a disabling button for disabling said at least one actuator by disconnecting power supply thereto.

15. The baby crib according to claim 9 further comprising at least one stabilizing means engaging said at least one drive unit for stabilizing the vertical displacement of said mattress support.

16. The baby crib according to claim 9, wherein said actuator comprises a bar and said locking device comprises at least one retractable pin that engages said bar, wherein said pin is arranged to hold said bar between grips that hold said mattress support for preventing vertical displacement thereof.

* * * * *